US009139391B2

(12) United States Patent
Nakamura et al.

(10) Patent No.: US 9,139,391 B2
(45) Date of Patent: Sep. 22, 2015

(54) SHEET CONVEYOR, IMAGE FORMING APPARATUS INCORPORATING SAME, AND METHOD OF PREVENTING SHEET SKEW

(71) Applicants: Mitsutaka Nakamura, Hyogo (JP); Masanori Namba, Kanagawa (JP); Toshikane Nishii, Osaka (JP); Haruyuki Honda, Kanagawa (JP); Munekazu Hirata, Osaka (JP)

(72) Inventors: Mitsutaka Nakamura, Hyogo (JP); Masanori Namba, Kanagawa (JP); Toshikane Nishii, Osaka (JP); Haruyuki Honda, Kanagawa (JP); Munekazu Hirata, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/320,720

(22) Filed: Jul. 1, 2014

(65) Prior Publication Data

US 2015/0014919 A1 Jan. 15, 2015

(30) Foreign Application Priority Data

Jul. 10, 2013 (JP) ..... 2013-144595

(51) Int. Cl.
*B65H 9/00* (2006.01)
*B65H 5/06* (2006.01)
*B65H 7/20* (2006.01)

(52) U.S. Cl.
CPC ..... *B65H 7/20* (2013.01); *B65H 5/062* (2013.01); *B65H 9/006* (2013.01); *B65H 2301/512125* (2013.01); *B65H 2403/72* (2013.01)

(58) Field of Classification Search
CPC .. B65H 9/004; B65H 9/006; B65H 2301/331; B65H 2301/512125; B65H 2404/7231; B65H 2301/5121; B65H 2301/51212
USPC ..... 271/242, 243
See application file for complete search history.

(56) References Cited

U.S. PATENT DOCUMENTS

| | | | | |
|---|---|---|---|---|
| 8,079,589 | B2 * | 12/2011 | Kinoshita et al. | 271/242 |
| 8,157,260 | B2 * | 4/2012 | Tsai et al. | 271/228 |
| 8,424,872 | B2 * | 4/2013 | Iwakawa | 271/242 |
| 8,876,111 | B1 * | 11/2014 | Lan | 271/304 |
| 2009/0250868 | A1 * | 10/2009 | Tsai et al. | 271/226 |
| 2011/0058873 | A1 | 3/2011 | Honda et al. | |
| 2013/0119598 | A1 * | 5/2013 | Kuo | 271/10.11 |
| 2013/0140759 | A1 * | 6/2013 | Kuo | 271/10.12 |

FOREIGN PATENT DOCUMENTS

| | | |
|---|---|---|
| JP | 5-338865 | 12/1993 |
| JP | 11-030884 | 2/1999 |
| JP | 2001-225992 | 8/2001 |
| JP | 2003-118890 | 4/2003 |

* cited by examiner

*Primary Examiner* — Patrick Cicchino
(74) *Attorney, Agent, or Firm* — Harness, Dickey & Pierce, P.L.C.

(57) ABSTRACT

A sheet conveyor, which is incorporated in an image forming apparatus and in which a method of preventing sheet skew is performed, includes a sheet conveying path through which a sheet is conveyed, a first conveying unit disposed in a sheet conveying direction and including a shaft extending in a lateral direction, multiple rollers attached to the shaft along the shaft, and a rotation regulator disposed between each of the multiple rollers and the shaft to idly rotate each of the multiple rollers in a given range about the shaft, a second conveying unit disposed along the sheet conveying path and downstream from the first conveying unit in the sheet conveying direction, and a sheet abutting part provided at the second conveying unit, against which a leading edge of the sheet abuts to form a slack of the sheet to correct skew of the sheet.

13 Claims, 21 Drawing Sheets

SHEET CONVEYOR, IMAGE FORMING APPARATUS INCORPORATING SAME, AND METHOD OF PREVENTING SHEET SKEW

CROSS-REFERENCE TO RELATED APPLICATIONS

This patent application is based on and claims priority pursuant to 35 U.S.C. §119(a) to Japanese Patent Application No. 2013-144595, filed on Jul. 10, 2013 in the Japan Patent Office, the entire disclosure of which is hereby incorporated by reference herein.

BACKGROUND

1. Technical Field

Embodiments of the present invention relate to a sheet conveyor, an image forming apparatus incorporating the sheet conveyor therein, and a method of preventing sheet skew in the sheet conveyor.

2. Related Art

As an example of sheet conveyance in known image forming apparatuses, sheets that function as transfer recording media loaded on a sheet conveying device are fed one by one as a sheet feed roller rotates to convey the fed sheet to an image transfer position in the image forming apparatus. The sheet fed by the sheet feed roller receives a toner image thereon at the image transfer position while a position of the toner image formed on a photoconductor drum or a photoconductor belt matches an image transfer position of the sheet. After the toner image is transferred onto the sheet and is fixed to the sheet by application of heat and pressure, the sheet is discharged as a print or copy.

To transfer the toner image onto the sheet with precise positioning, these image forming apparatuses generally include a timing mechanism to match a timing in which the sheet is fed with a timing in which the toner image arrives at the image transfer position in the image forming apparatus. Examples of the timing mechanism are disclosed in Japanese Unexamined Utility Model (Registration) Application Publication No. JP S64-000555-A and Japanese Patent Application Publication No. IP H05-338865-A.

JP S64-000555-A discloses a configuration of an image forming apparatus including a gate member. The gate member is disposed upstream from a timing roller pair that conveys a sheet according to a transfer timing. The gate member can freely advance/retreat with respect to a sheet conveying path.

JP H05-338865-A discloses a configuration of an image forming apparatus that does not include the gate member but includes a mechanism to abut a leading edge of a sheet forcedly against a nip contact area that is formed between rollers of a timing roller pair.

By temporarily continuing the sheet conveyance while the leading edge of the sheet is once pressed against the gate member or the nip contact area, a part of the sheet slacks to form a sag or a curve in the sheet. And, at the same time, skew of the sheet is corrected by pressing the leading edge of the sheet against the gate member or the nip contact area. The skew of the sheet is caused due to difference in accuracy in parts or components such as sheet conveying rollers and/or due to incorrect setting of the sheet with respect to the sheet conveying device. For these reasons, a skew correction mechanism is demanded.

Japanese Patent Application Publication No. JP 2003-118890-A discloses a configuration of a sheet conveying device that eliminates deviation of amounts of slacks in a sheet or a slack amount deviation of a sheet. The sheet conveying device disclosed in JP 2003-118890-A includes two drive rollers and two respective driven rollers. The drive rollers and the driven rollers are individually slidable in an axis direction of respective shafts of the drive and driven rollers.

Each of the rollers rotates idly when receiving a force applied in the sheet conveying direction PD and remains unrotated when receiving a force applied in an opposite direction of the sheet conveying direction PD. According to this configuration, the sheet can easily move in a left or right direction immediately when the slack of the sheet is formed. This movement of sheet can eliminate the slack amount deviation at the left and right sides of the sheet.

However, the sheet conveying device disclosed in JP 2003-118890-A may also include a return spring to return a roller or rollers slid in the axial direction to an initial center position (a home position). A force applied by the return spring constantly acts in a thrust direction of the rollers during image transfer. Therefore, the sheet during image transfer rotates by the force in the thrust direction, and this can result in production of the trapezoidal defect image.

Further, as an alternate member to the return spring, a more complex mechanism may be employed so as not to apply the force in the thrust direction of the rollers during image transfer, which results in an increase in cost. In addition, the rollers to the initial center position (the home position) may need to return while the sheet is not passing through the roller during intervals of sheets, and therefore high printing performance cannot be achieved.

SUMMARY

At least one embodiment of the present invention provides a sheet conveyor including a sheet conveying path, a first conveying unit, a second conveying unit, and a sheet abutting part. A sheet is conveyed through the sheet conveying path. The first conveying unit is disposed along the sheet conveying path in a sheet conveying direction, and includes a shaft extending in a lateral direction perpendicular to the sheet conveying direction, multiple rollers fixed to the shaft in the lateral direction along the shaft, and a rotation regulator disposed between each of the multiple rollers and the shaft and to cause each of the multiple rollers to idly rotate in a given range about the shaft. The second conveying unit is disposed along the sheet conveying path and downstream from the first conveying unit in the sheet conveying direction. The sheet abutting part is provided at the second conveying unit, against which a leading edge of the sheet conveyed from the first conveying unit abuts to form a slack of the sheet to correct skew of the sheet.

Further, at least one embodiment of the present invention provides an image forming apparatus including an image forming part to form an image and the above-described sheet conveyor.

Further, at least one embodiment of the present invention provides a sheet conveyor including a sheet conveying path, a first conveying unit, a second conveying unit, and a sheet abutting part. A sheet is conveyed through the sheet conveying path. The first conveying unit is disposed along the sheet conveying path in a sheet conveying direction, and includes a shaft extending in a lateral direction perpendicular to the sheet conveying direction, multiple rollers fixed to the shaft in the lateral direction along the shaft, and a one-way clutch disposed between each of the multiple rollers and the shaft and to cause each of the multiple rollers to idly rotate about the shaft when each of the multiple rollers receives a rotation force applied in the sheet conveying direction and to remain unrotated when each of the multiple rollers receives a different rotation force applied in a direction opposite to the sheet conveying direction. The second conveying unit is disposed along the sheet conveying path and downstream from the first conveying unit in the sheet conveying direction. The sheet abutting part is provided at the second conveying unit, against which a leading edge of the sheet conveyed from the first conveying unit abuts by which a slack of the sheet is formed to correct skew of the sheet.

Further, at least one embodiment of the present invention provides an image forming apparatus including an image forming part to form an image and the above-described sheet conveyor.

Further, at least one embodiment of the present invention provides a method of preventing sheet skew including providing a first conveying unit and a second conveying unit in a sheet conveying path of an image forming apparatus, the first conveying unit having a shaft and multiple rollers fixed to the shaft in an axial direction, disposing a rotation regulator between each of the multiple rollers and the shaft, conveying a sheet between the first conveying unit and the second conveying unit through the sheet conveying path, causing a leading edge of the sheet to abut against a sheet abutting part of the second conveying unit, forming given amounts of slack on both opposite sides of the sheet, and regulating idle rotation of the multiple rollers in a given range according to deviation of the amount of slack in the sheet.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
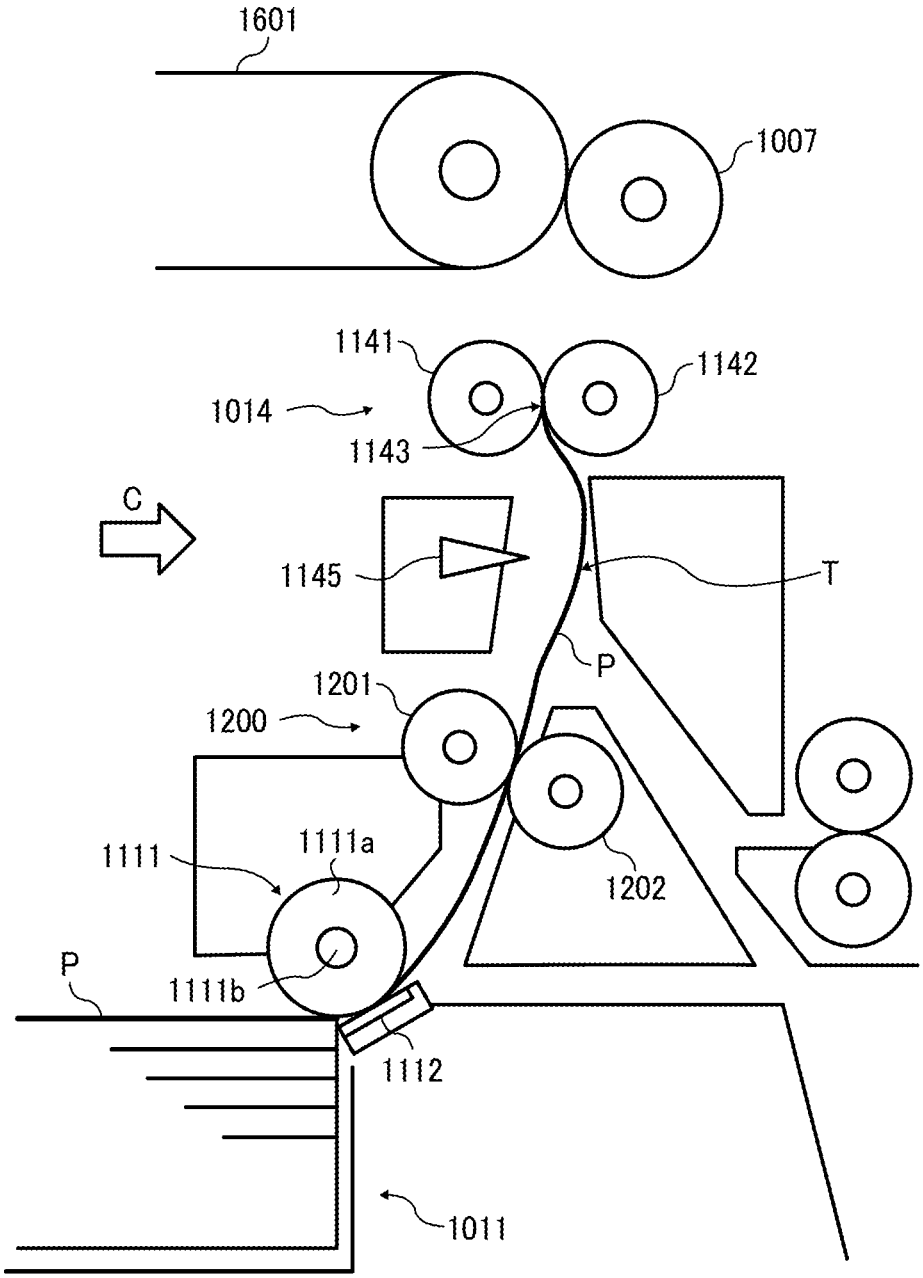
FIG. 1 is a diagram illustrating a schematic configuration of a known sheet conveyor as a comparative example.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

Here, a description is given of a known sheet conveying device as a comparative example, with reference to FIGS. 1 through 4.

FIG. 1 is a diagram illustrating a configuration of a known sheet conveying device that functions as a sheet conveyor and has a known timing mechanism. The following description relates to a configuration and functions of the sheet conveying device.

FIG. 1 depicts a state in which a sheet P is conveyed from a sheet container 1011 and the leading edge of the sheet P is abutted against a nip contact area of a timing roller pair 1014 to form a slack or a curve.

In the sheet conveying device, the sheet P is fed by a sheet feed roller 1111*a* of a sheet feeding device 1111. The sheet feed roller 1111*a* is fixed to a shaft 1111*b* that is rotated by a drive unit. The sheet feed roller 1111*a* is rotated counterclockwise as in FIG. 1. A friction pad 1112 prevents multifeeding of the sheets. The friction pad 1112 is pressed against an outer circumferential surface of the sheet feed roller 1111*a*. The sheet P is sent between the sheet feed roller 1111*a* and the friction pad 1112.

After passing between a relay roller pair 1200 that has already started to rotate, the leading edge of the sheet P abuts against the nip contact area of the timing roller pair 1014 that remains unrotated. The relay roller pair 1200 functions as a first conveying unit and the timing roller pair 1014 functions as a second conveying unit. Thereafter, the sheet feed roller 1111*a* and the relay roller pair 1200 rotate for a given time and then stop. With this action, a given amount of slack (curve) T is formed in the sheet P. After triggered by a timing in which an abutment sensor 1145 detects the leading edge of the sheet P, the amount of slack in the sheet can be constant by stopping the sheet feed roller 1111*a* and the relay roller pair 1200 at a given timing.

Then, in synchronization with a sheet conveying position of a toner image held on an intermediate transfer belt 1601, the sheet feed roller 1111*a*, the relay roller pair 1200, and the timing roller pair 1014 are driven. With this action, the sheet P with the skew thereof being corrected is conveyed toward an image transfer position disposed downstream from the timing roller pair 1014. Accordingly, an image foamed for the leading edge of the sheet P can be transferred onto the sheet P with accuracy. The intermediate transfer belt 1601 is disposed in contact with a transfer unit 1007.

The relay roller pair 1200 that functions as a first conveying unit includes a first conveyance drive roller 1202 and a first conveying driven roller 1201. The timing roller pair 1014 that functions as a second conveying unit includes a second conveyance drive roller 1141 and a second conveyance driven roller 1142. A nip contact area is formed between two rollers 1141 and 1142 of the timing roller pair 1014. The nip contact area corresponds to a sheet abutting part 1143.

In recent years, image forming apparatuses on the market have been facing growing demands for space-saving and enhancement of sheet-size compatibility. However, due to space-saving, it is difficult, for example, to convey a thick paper having a weight of from 300 g/m$^2$ to 400 g/m$^2$ from the sheet feed roller 1111*a* to the timing roller pair 1014 at once. As a relay member, the relay roller pair 1200 is constantly included so as to enhance compatibility with a variety of sheets. However, once the leading edge of the sheet P abuts against the sheet abutting part 1143, the relay roller pair 1200 can remain unrotated.

Specifically, the timing roller pair 1014 has relatively large nip pressure and conveying force compared with those of the sheet feed roller 1111*a* and the relay roller pair 1200. It is because, if the sheet P slips at the timing roller pair 1014 while traveling after abutting against the sheet abutting part 1143 that is defined by the nip contact area, the sheet P cannot meet with high accuracy with the leading edge of an image formed on the intermediate transfer belt 1601. Therefore, as long as the configuration includes the relay roller pair 1200 that is rotated along with conveyance of the sheet P, the sheet P is conveyed by the conveying force of the timing roller pair 1014 without driving the relay roller pair 1200.

A large number of known image forming apparatuses including a transfer unit such as a belt and/or a roller are provided with an abutting member to control a timing of meeting the sheet P with the image so that the image is transferred onto the sheet P accurately and correct skew. However, for a recent increase in demands of space-savings and for handling thick papers to improve the paper-size compatibility, these known image forming apparatuses having the transfer unit tend to produce defect images.

Specifically, due to demands of a smaller diameter of a sheet guide turn for space-saving, a conveying member that can apply a large conveying force between a sheet feeding device (e.g., the sheet feeding device 1111) and a sheet abutting part (e.g., the sheet abutting part 1143) feeds a thick paper from the sheet feeding device properly, which results in a shorter path distance between the conveying member and the sheet abutting part.

In the thus short path distance between the conveying member and the sheet abutting part, the sheet P that is set significantly diagonally abuts against the sheet abutting part to form slack to correct the skew of the sheet P. This correction, however, tends to convey the sheet P to the transfer unit with different amounts of slacks on the right side and the left side of the sheet P. Accordingly, deviation of reacting forces applied to both left and right sides of the sheet P in the lateral direction of the sheet P occurs due to rigidity of the slacked sheet while transferring the image onto the sheet P. Further, due to the deviation of reacting forces of the left and right sides of the sheet P in a direction perpendicular to a sheet conveying direction PD (see FIG. 3A), the sheet P slips by different amounts on the left and right sides of the sheet in the transfer unit. Therefore, a defect image is produced as a trapezoidal image (IMAGE 1 illustrated in FIG. 4) which has different image lengths on the left and right side of the sheet P.

Now, detailed descriptions are given of sheet movement related to actions of the relay roller pair 1200 and the timing roller pair 1014 and occurrence of image defect.

Figure 2:
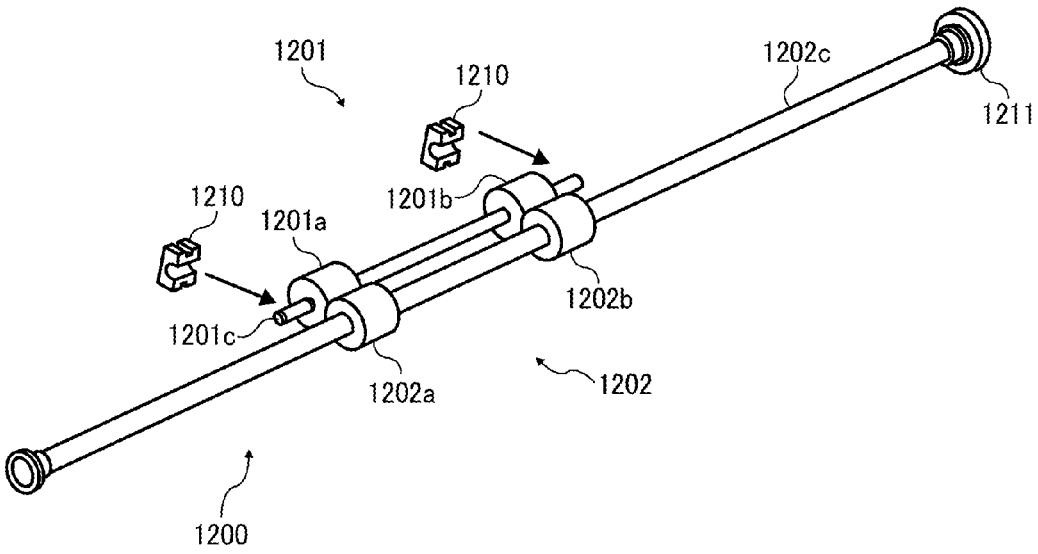
FIG. 2 is a perspective view illustrating a first driving member of the sheet conveyor of FIG. 1.

FIG. 2 is a perspective view illustrating the relay roller pair 1200 disposed between the sheet feed roller 1111 and the sheet abutting part 1143. The relay roller pair 1200 includes the first conveying driven roller unit 1201 and the first conveyance drive roller unit 1202.

The first conveying driven roller unit 1201 includes two driven rollers 1201*a* and 1201*b* and a shaft 1201*c*. The driven rollers 1201*a* and 1201*b* are attached to the shaft 1201*c*, both ends of which are supported by respective bearings 1210. The driven rollers 1201*a* and 1201*b* may be fixed to the shaft 1201*c* or may be rotatably attached to the shaft 1201*c*. The bearings 1210 are biased toward the first conveyance drive roller unit 1202 by respective springs functioning as biasing members.

The first conveyance drive roller unit 1202 includes idling rollers 1202*a* and 1202*b* and a conveying shaft 1202*c*. The idling rollers 1202*a* and 1202*b* are frictional members such as rubber members. The idling rollers 1202*a* and 1202*b* are fixed to the conveying shaft 1202*c* that is rotated by a drive unit. The first conveyance drive roller unit 1202 are driven by a driving source via a clutch and a gear 1211. The sheet P is sandwiched between the first conveying driven roller unit 1201 and the first conveyance drive roller 1202 by a biasing force of the first conveying driven roller unit 1201. With this state of the sheet P, the first conveying driven roller unit 1201 rotates when the clutch is ON and stops when the clutch is OFF.

FIGS. 3A through 3D are diagrams illustrating a series of movements of the sheet P when viewing the sheet conveying device from a direction indicated by arrow C as illustrated in FIG. 1. FIG. 4 is a trapezoidal image produced due to skew of the sheet P.

Figure 3A:
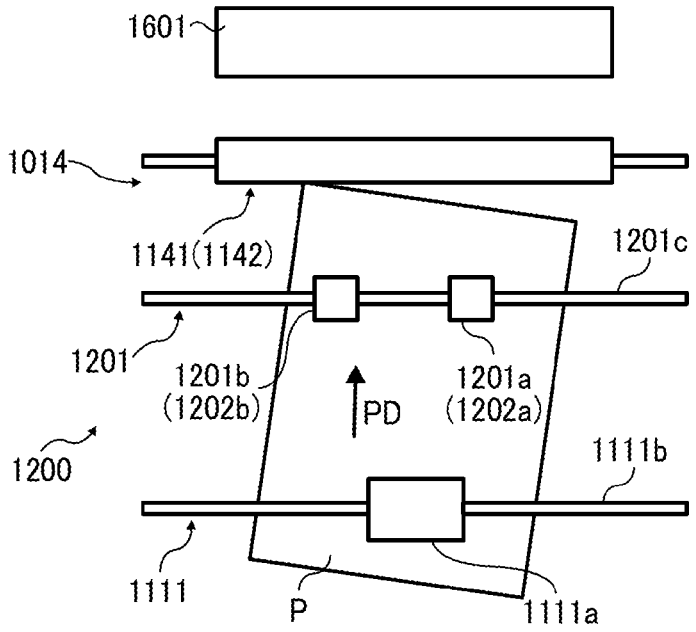
FIGS. 3A through 3D are diagrams illustrating formation of sheet slack and slippage at a transfer unit of the sheet conveyor of FIG. 1.
Figure 3B:
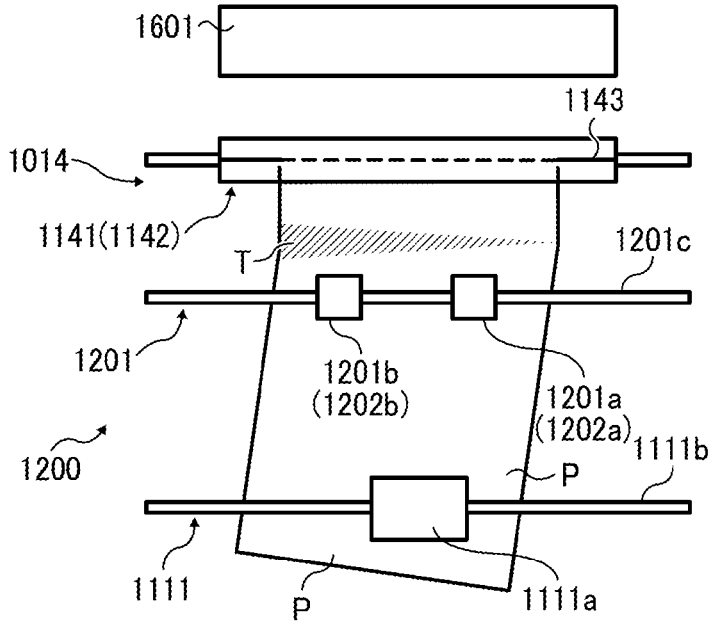
Figure 4:
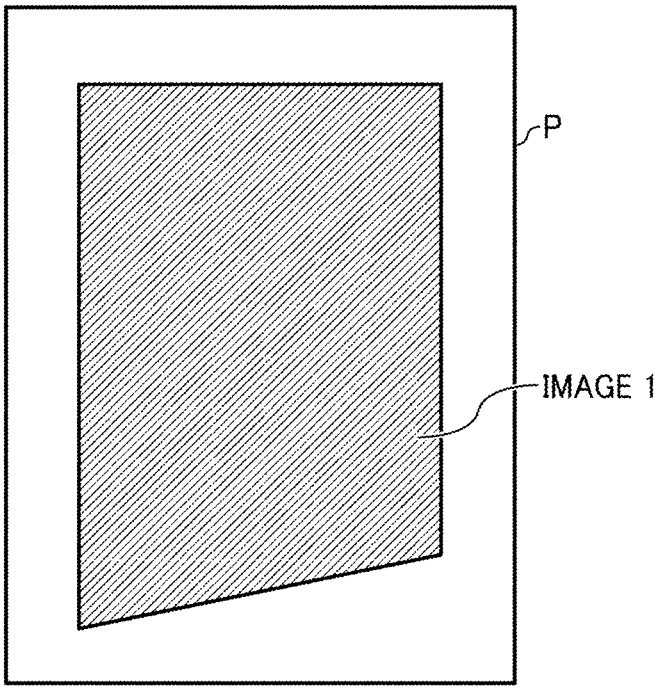
FIG. 4 is a diagram illustrating an image defect (a trapezoidal image) caused by sheet conveyance of the sheet conveyor of FIG. 1.

As illustrated in FIG. 3A, the sheet P fed by the sheet feed roller 1111*a* can be skewed depending on how a user sets the sheet P with respect to the sheet conveying device. The skew can be corrected by forming a slack T by abutting the leading edge of the sheet P against the sheet abutting part 1143 of the timing roller pair 1014, as illustrated in FIG. 3B. At this time, amounts of slack on the left and right sides of the sheet P are different. As the skew increases, the amount of slacks of the sheet P also increase.

Figure 3C:
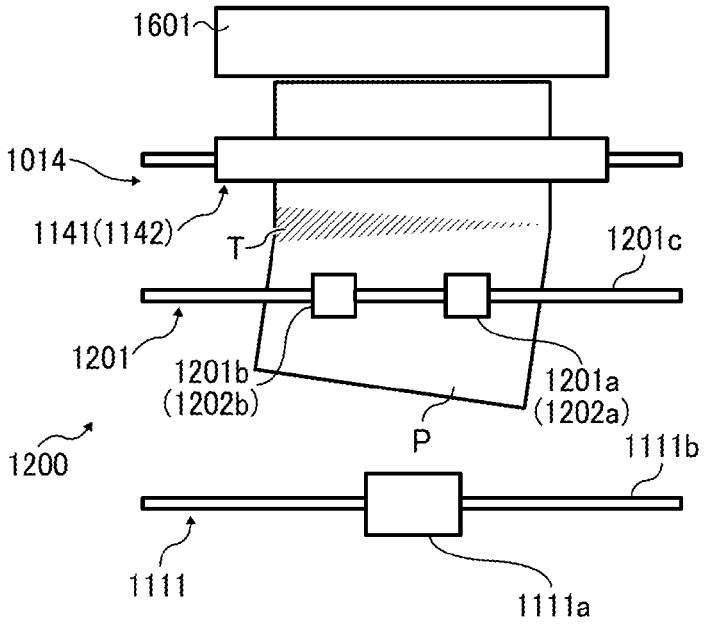

After the leading edge of the sheet P abuts against the sheet abutting part 1143, the timing roller pair 1014 is driven to start conveying the sheet P to the intermediate transfer belt 1601 that is disposed downstream from the timing roller pair 1014, as illustrated in FIG. 3C, to start transferring the image onto the sheet P. At this time, since the idling rollers 1202*a* and 1202*b* of the first conveyance drive roller unit 1202 are fixed to the conveying shaft 1202*c*, the idling rollers 1202*a* and 1202*b* rotate with substantially zero chances of slipping with the sheet P.

According to the above-described reasons, the deviation of slack amounts on the left and right sides of the sheet P still exists. Therefore, a pressing force to press the sheet P to the transfer unit is exerted on a slacked side of the sheet P (on the left side in FIG. 3C) during the sheet conveyance due to the reacting force caused by rigidity of the sheet P.

Figure 3D:
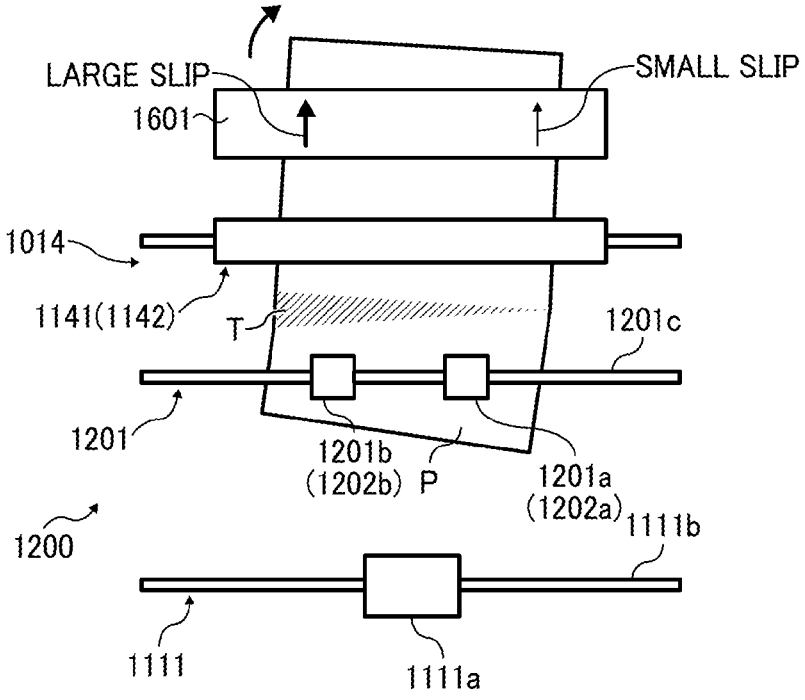

As a result, as illustrated in FIG. 3D, even while the image is being transferred onto the sheet P, the sheet P on the intermediate transfer belt 1601 slips in the sheet conveying direction PD and has a larger slip on the outward slacked side as indicated by a bold arrow in FIG. 3D. Accordingly, a force in a rotation direction (a clockwise direction) is continuously applied. This produces a defect image having different image lengths on the left and right sides of the sheet P, which results in production of the trapezoidal image.

A solid image is formed on the entire surface of the sheet P with a large amount of toner consumption. Such a solid image can increase slip differences on the left and right sides of the sheet P, and therefore the worse trapezoidal image may be produced. Further, this tendency can be more pronounced when the sheet length is relatively long, such as a long sheet.

Now, a description is given of a sheet conveyor 1100 according to an embodiment of the present invention and an image forming apparatus 1000 incorporating the sheet conveyor 1100.

The image forming apparatus 1000 may be a copier, a facsimile machine, a printer, a plotter, a multifunction peripheral or a multifunction printer (MFP) having at least one of copying, printing, scanning, facsimile, and plotter functions, or the like. According to the present embodiment, the image forming apparatus 1000 is a color electrophotographic printer that forms color and monochrome toner images on a sheet or sheets by electrophotography.

Further, it is to be noted in the following embodiments that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

Figure 5:
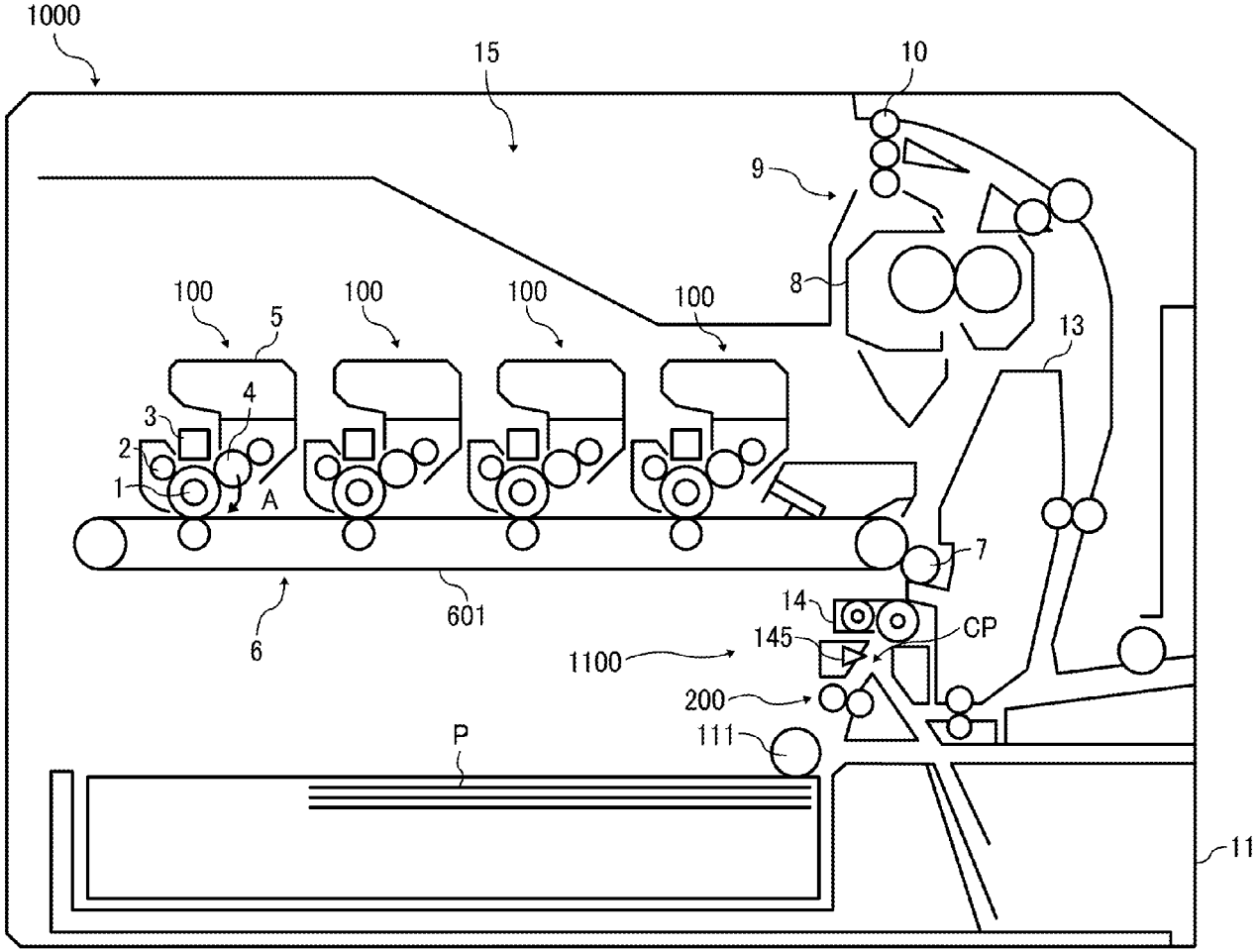
FIG. 5 is a diagram illustrating a schematic configuration of an image forming apparatus having a sheet conveyor according to an embodiment of the present invention.

The image forming apparatus 1000 includes multiple image forming devices 100, each of which functions as an image forming part. It is to be noted that FIG. 5 illustrates four image forming devices 100 having the identical configuration to each other except toner colors, which are yellow (Y), magenta (M), cyan (C), and black (K). Each image forming device 100 includes a photoconductor 1 and an image forming components disposed around the photoconductor 1, which are a charger 2, an LED (light emitting diode) 3, a development unit 4, and a developer cartridge 5.

The photoconductor 1 is a cylindrical shaped image carrier that rotates in a direction indicated by arrow A in FIG. 5. The charger 2 uniformly charges a surface of the photoconductor 1. The LED 3 functions as a light source to form an electrostatic latent image on the surface of the photoconductor 1 by exposing the surface of the photoconductor 1 based on image data.

The development unit 4 is disposed adjacent to the LED 3 to develop the electrostatic latent image formed on the photoconductor 1 into a visible toner image with toner (developer). The developer cartridge 5 is disposed above the development unit 4 to accommodate the developer.

The image forming apparatus 1000 further includes an intermediate transfer unit 6, a transfer unit 7, a fixing unit 8, a sheet discharging unit 9, a reverse unit 10, a sheet container 11, a duplex sheet conveying path 13, and a sheet discharging tray 15.

The intermediate transfer unit 6 is disposed below the image forming devices 100 and includes an intermediate transfer belt 601 on which respective toner images formed on the corresponding photoconductors 1 are transferred and superimposed sequentially. The transfer unit 7 includes a transfer roller to transfer the composite toner image formed on the intermediate transfer unit 6 onto a sheet (a recording medium) P.

The fixing unit 8 fixes the toner image transferred onto the sheet P. The sheet discharging unit 9 discharges the sheet P to an outside of the image forming apparatus 1000. The reverse unit 10 conveys the sheet P to the duplex sheet conveying path 13 for duplex printing after a first face of the sheet P is printed. The sheet container 11 accommodates a sheet stack of the sheets P. The duplex sheet conveying path 13 is a path used for duplex printing to which the sheet P with the first face thereof printed is conveyed from the reverse unit 10.

The image forming apparatus 1000 further includes the sheet conveyor 1100.

Now, a description is given of a configuration and functions of the sheet conveyor 1100 with reference to FIGS. 6A through 6D.

Figure 6A:
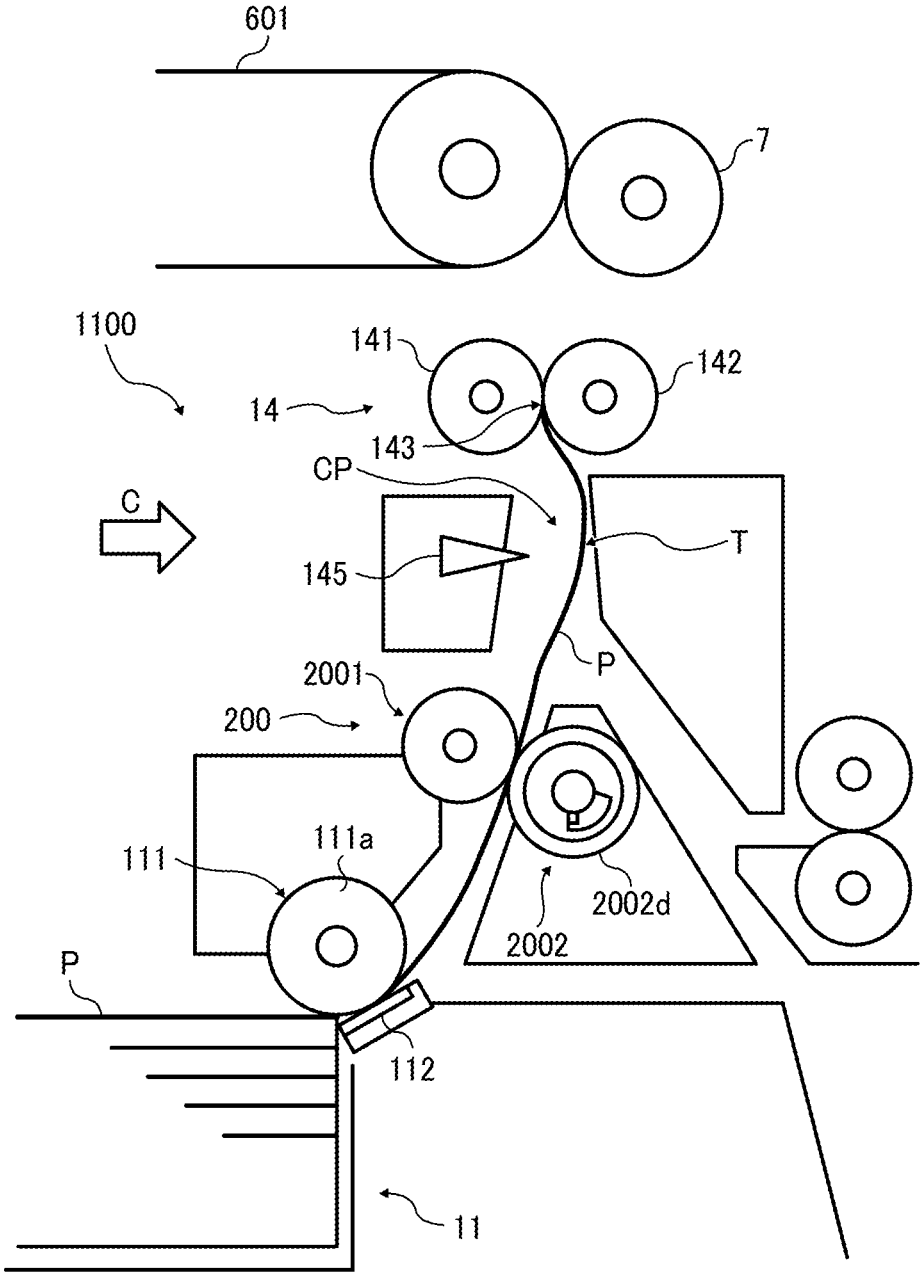
FIG. 6A is a diagram illustrating a schematic configuration of the sheet conveyor according to an embodiment when the sheet conveyor handles a sheet with slack.
Figure 6B:
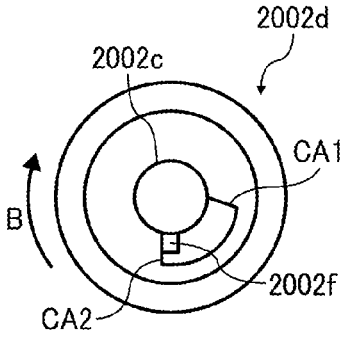
FIGS. 6B and 6C are side views illustrating respective rollers and pins of a first conveying unit of the sheet conveyor of FIG. 6A.
Figure 6C:
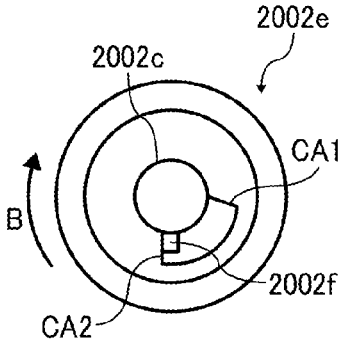
Figure 6D:
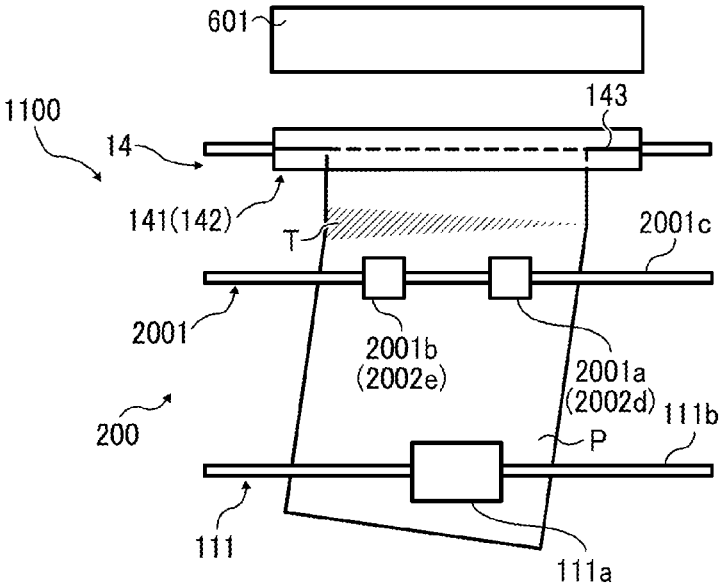
FIG. 6D is a diagram illustrating the sheet viewed from a direction C before slack of the sheet is eliminated.

FIG. 6A is a schematic configuration of the sheet conveyor 1100 according to an embodiment when the sheet conveyor 1100 handles the sheet P with slack. FIGS. 6B and 6C are side views illustrating respective idling rollers 2002*d* and 2002*e* and respective pins 2002*f* of a relay roller pair 200. FIG. 6D is a diagram illustrating the sheet P viewed from a direction C before elimination of the slack of the sheet P.

The idling roller 2002*e* illustrated in FIG. 6C is disposed behind the idling roller 2002*d* along the axial direction of a conveying shaft 2002*c*.

The sheet conveyor 1100 includes the relay roller pair 200 and a timing roller pair 14 are disposed upstream from the transfer unit 7 in a sheet conveying direction. The relay roller pair 200 functions as a first conveying unit and the timing roller pair 14 functions as a second conveying unit. During a sheet conveying operation, the sheet P is slacked when conveyed in a sheet conveying path CP between the relay roller pair 200 and the timing roller pair 14 and then fed to the intermediate transfer belt 601 at a given timing, so that a position of the toner image formed on the intermediate transfer belt 601 meets a correct position of the sheet P precisely at a timing immediately before the toner image is transferred onto the sheet P.

When the sheet P is fed by a sheet feed roller 111*a* of a sheet feeding device 111. A friction pad 112 that prevents multi-feeding of the sheets is pressed against an outer circumferential surface of the sheet feed roller 111*a*. The sheet P is sent between the sheet feed roller 111*a* and the friction pad 112.

After passing through the relay roller pair 200 that has already started to rotate, the leading edge of the sheet P abuts against the nip contact area of the timing roller pair 14 that remains unrotated. Thereafter, the sheet feed roller 111*a* and the relay roller pair 200 rotate for a given time and then stop. With this action, a given amount of slack (curve) T is formed in the sheet P. After triggered by a timing in which an abutment sensor 145 detects the leading edge of the sheet P, the amount of slack T in the sheet P can be constant by stopping the sheet feed roller 111*a* and the relay roller pair 200 at a given timing.

Then, in synchronization with a sheet conveying position of the toner image held on the intermediate transfer belt 601, the sheet feed roller 111*a*, the relay roller pair 200, and the timing roller pair 14 are driven. With this action, the sheet P with the skew thereof being corrected is conveyed toward an image transfer position disposed downstream from the timing roller pair 14. Accordingly, an image formed for the leading edge of the sheet P can be transferred onto the sheet P with accuracy. The intermediate transfer belt 601 is disposed in contact with the transfer unit 7.

As illustrated in FIG. 6A, the sheet P fed by the sheet feed roller 111*a* can be skewed depending on how a user sets the sheet P with respect to the sheet conveyor 1100. The skew can be corrected by forming a slack T by abutting the leading edge of the sheet P against the sheet abutting part 143 of the timing roller pair 14, as illustrated in FIG. 6A. At this time, respective amounts of slack on the left and right sides of the sheets are different. As the skew increases, the amount of slacks also increase.

After the leading edge of the sheet P abuts against the sheet abutting part 143, the timing roller pair 14 is driven to start conveying the sheet P to the intermediate transfer belt 601 that is disposed downstream from the timing roller pair 14, as illustrated in FIG. 6A, to start transferring the image onto the sheet P.

With the sheet conveyor 1100 according to the present embodiment, even when the sheet P is skewed due to improper sheet setting in the sheet container 11, the skew is corrected automatically. The skew correction is performed by rotating the idling rollers 2002*d* and 2002*e* disposed on the left and right sides of the relay roller pair 200.

Detailed descriptions of configurations and functions of the relay roller pair 200 and the timing roller pair 14, with reference to FIGS. 7, 8, 9A, and 9B.

Figure 7:
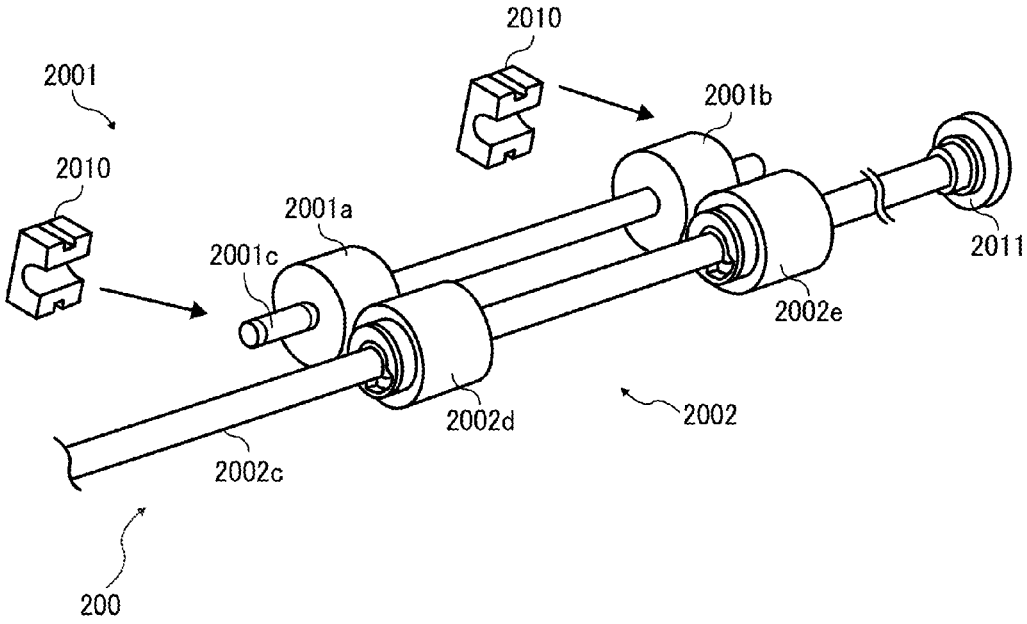
FIG. 7 is a perspective view illustrating the first conveying unit.
Figure 8:
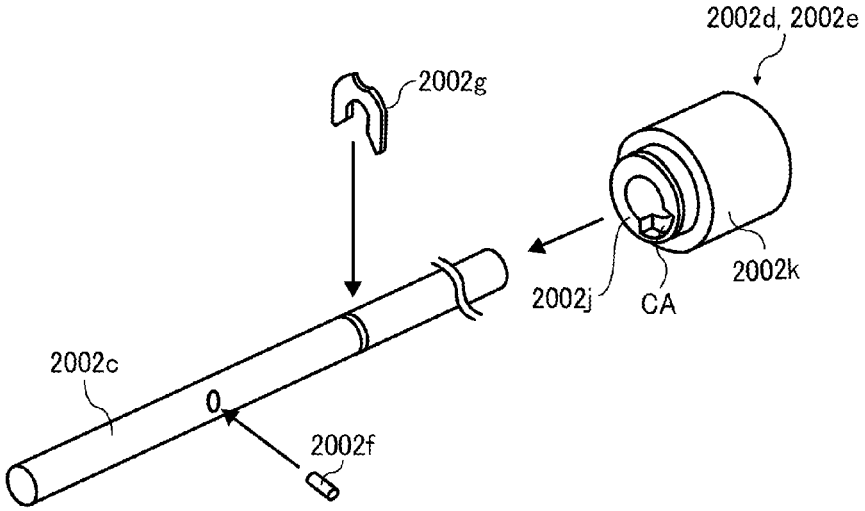
FIG. 8 is an exploded perspective view illustrating a driving roller included in the first conveying unit.
Figure 9A:
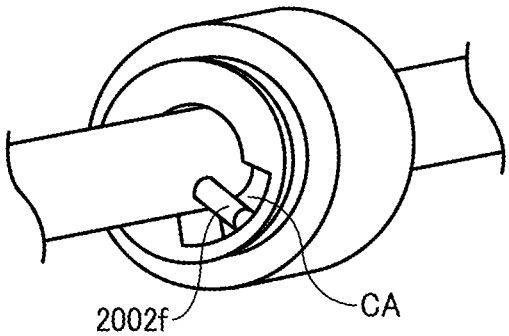
FIGS. 9A and 9B are perspective views illustrating the driving roller of the first conveying unit, viewed from different angles from each other.
Figure 9B:
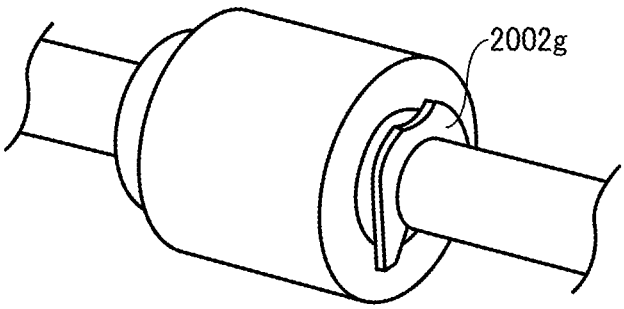

FIG. 7 is a perspective view illustrating the relay roller pair 200. FIG. 8 is an exploded perspective view illustrating the idling rollers 2002*d* and 2002*e* included in the relay roller pair 200. FIGS. 9A and 9B are perspective views illustrating the idling rollers 2002*d* and 2002*e* of the relay roller pair 200, viewed from different angles from each other.

As illustrated in FIG. 7, the relay roller pair 200 of the sheet conveyor 1100 includes a first conveying driven roller 2001 and a first conveying drive roller 2002.

The sheet P is sandwiched between the first conveying driven roller unit 2001 and the first conveying drive roller 2002 by a biasing force of the first conveying driven roller unit 2001. With this state of the sheet P, the first conveying driven roller unit 2001 rotates when the clutch is ON and stops when the clutch is OFF.

The first conveying driven roller 2001 includes two driven rollers 2001*a* and 2001*b* and a conveying shaft 2001*c*. The driven rollers 2001*a* and 2001*b* are attached to be rotated idly with respect to the conveying shaft 2001*c*. The conveying shaft 2001*c* is supported by respective bearings 2010 at both ends thereof. The bearings 2010 are biased by springs. Each of the springs functions as a biasing member to bias the corresponding one of the bearings 2010 toward the first conveying drive roller 2002.

The first conveying drive roller 2002 of the sheet conveyor 1100 includes two idling rollers 2002*d* and 2002*e* and a conveying shaft 2002*c*. Each of the idling rollers 2002*d* and 2002*e* has a frictional material such as a rubber material covering over a circumferential surface thereof. The idling rollers 2002*d* and 2002*e* are attached to the conveying shaft 2002*c* that is driven by a driving unit. The conveying shaft 2002*c* extends in a lateral direction that is a direction perpendicular to the sheet conveying direction. The conveying shaft 2002*c* is driven by a driving source via a clutch and a gear 2011.

It is to be noted that the numbers of driven rollers (i.e., the driven rollers 2001*a* and 2001*b*) and of idling rollers (i.e., the idling rollers 2002*d* and 2002*e*) are not limited to two but can be three or more.

The idling rollers 2002*d* and 2002*e* are fixed to respective positions in an axial direction of the conveying shaft 2002*c* and can idly rotate circumferentially within a range of a given angle individually. With the sheet P held between the first conveying drive roller 2002 and the first conveying driven roller 2001 by the biasing force of the first conveying driven roller 2001, switching ON/OFF of the clutch drives/stops the first conveying drive roller 2002, respectively.

Specifically, as illustrated in FIG. 8, the idling rollers 2002*d* and 2002*e* are prepared by press-fitting or adhesion of a friction member 2002*k* such as a rubber member to a hub 2002*j* having a fan-shaped cutout CA that functions as a rotation regulator. After each of the idling rollers 2002*d* and 2002*e* is inserted into the conveying shaft 2002*c*, a retaining ring 2002*g* and a pin 2002*f* that functions as a rotation regulator are attached to the conveying shaft 2002*c*.

As illustrated in FIGS. 9A and 9B, the idling rollers 2002*d* and 2002*e* can idly rotate with respect to the conveying shaft 2002*c* within the range in which the pin 2002*f* moves in the cutout CA that is provided to each of the idling rollers 2002*d* and 2002*e*. Further, sandwiching the idling rollers 2002*d* and 2002*e* with the pin 2002*f* and retaining ring 2002*g* prevents the idling rollers 2002*d* and 2002*e* from being pulled out in a thrust direction thereof.

It is to be noted that, a rotation regulator is not limited to the pin 2002*f* and the cutout CA. Any modified member having the similar functions can be applied as a rotation regulator.

The timing roller pair 14 of the sheet conveyor 1100 includes a second conveyance drive roller 141 and a second conveyance driven roller 142. A nip contact area that is formed between the second conveyance drive roller 141 and the second conveyance driven roller 142 of the timing roller pair 14 corresponds to a sheet abutting part 143. The second conveyance drive roller 141 is driven according to a timing clutch by switching ON/OFF.

The relay roller pair 200 and the timing roller pair 14 of the sheet conveyor 1100 have the above-described configurations.

In the sheet conveyor 1100, the sheet P loaded in the sheet container 11 is initially fed by the sheet feed roller 111*a* toward the relay roller pair 200. After having passed through the relay roller pair 200 that has already been rotated, the sheet P abuts the leading edge thereof against the sheet abutting part 143 that is formed by the nip contact area of the timing roller pair 14 that remains unrotated.

Thereafter, the sheet feed roller 111*a* and the relay roller pair 200 rotate for a given period and stop. With this action, a given amount of slack T is given to the sheet P. Triggered by a timing at which the abutment sensor 145 detects the leading edge of the sheet P, the slack amount of the sheet P can remain stable by stopping the sheet feed roller 111*a* and the first conveying unit 200 at a given timing. Consequently, the timing roller pair 14 starts conveying the toner image formed on the intermediate transfer belt 601 at a given timing, and the sheet P is discharged to the sheet discharging tray 15 after the intermediate transfer, fixing, and sheet discharging processes.

It is to be noted that a relation of a conveyance speed V1 of the relay roller pair 200 and a conveying speed V2 of the timing roller pair 14 is expressed as V1=V2 or V1<V2.

By forming the slack T at an upstream position of the sheet abutting part 143 as described above, even when the sheet P is conveyed obliquely from the sheet container 11, even when the leading edge of the sheet P abuts against the timing roller pair 14, the skew of the sheet P can be corrected. The deviation of slack amounts on both left and right sides of the sheet P in the lateral direction is illustrated in FIG. 6D.

As illustrated in FIGS. 6B and 6C, as the pin 2002*f* contacts a wall CA2 of the cutout CA with the identical phase of the idling rollers 2002*d* and 2002*e* of the relay roller pair 200 at this time. The pin 2002*f* reliably contacts the wall CA2 with the identical phase even if the initial phases of the idling rollers 2002*d* and 2002*e* are different.

Specifically, the idling rollers 2002*d* and 2002*e* are exposed to the load applied by the biasing force of the first conveying driven roller 2001. Therefore, when a driving force is transmitted by the gear 2011 illustrated in FIG. 7 to the first conveying drive roller 2002, the idling rollers 2002*d* and 2002*e* idly rotate individually with respect to the conveying shaft 2002*c* to fill a space between the wall CA2 and the pin 2002*f*. Accordingly, the phases of the idling roller 2002*d* and the idling roller 2002*e* are aligned. Consequently, wherever the initial phases of the idling rollers 2002*d* and 2002*e* are located, the pin 2002*f* contacts the wall CA2 of the cutout CA of the idling rollers 2002*d* and 2002*e* with the same phase as illustrated in FIGS. 6B and 6C.

Figure 10A:
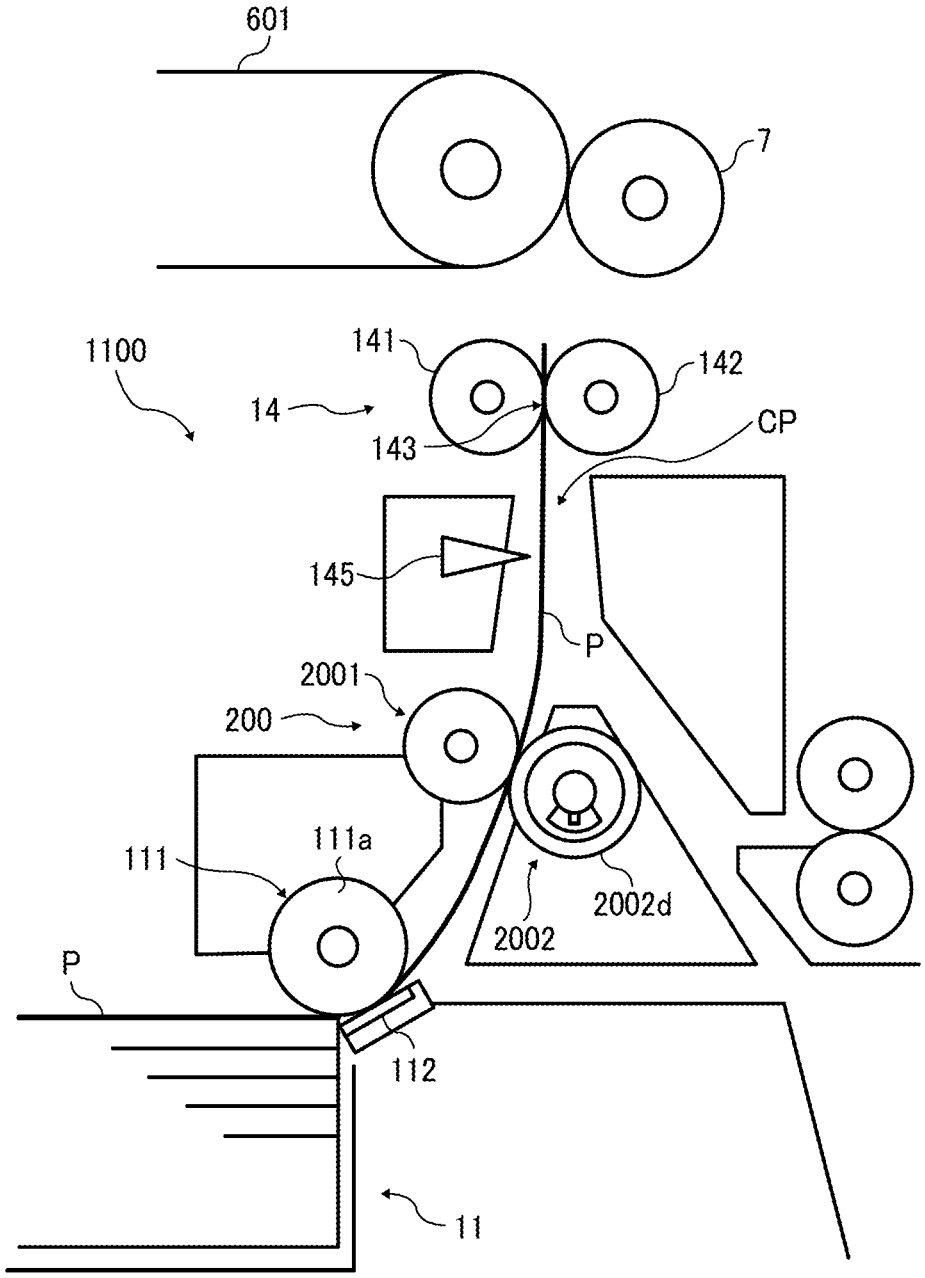
FIG. 10A is a diagram illustrating a schematic configuration of the sheet conveyor.
Figure 10B:
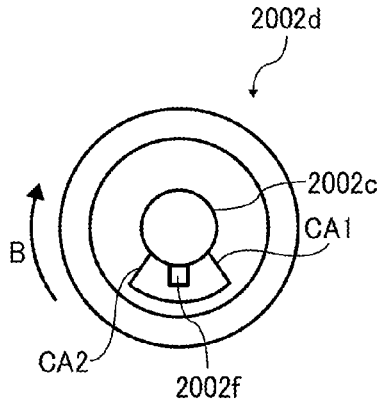
FIGS. 10B and 10C are side views illustrating respective rollers and pins of the first conveying unit of FIG. 10.
Figure 10C:
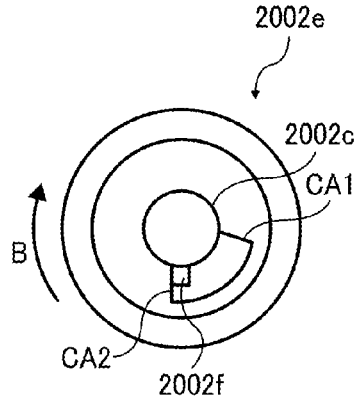
Figure 10D:
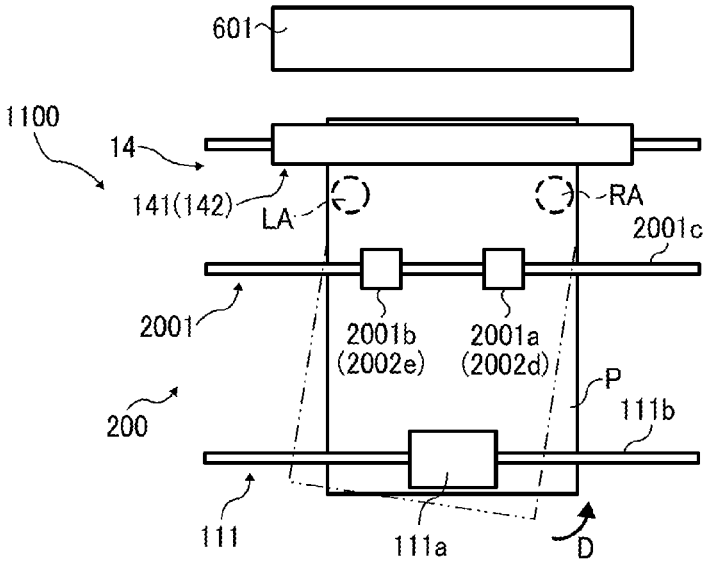
FIG. 10D is a diagram illustrating the sheet viewed from a direction C after the slack of the sheet is eliminated.

FIGS. 10A through 10D are diagrams illustrating the configurations of the sheet conveyor 1100, when the deviation of the slacks T of the sheet P is eliminated by driving the timing roller pair 14. FIG. 10A is a schematic configuration of the sheet conveyor 1100. FIGS. 10B and 10C are side views illustrating the idling rollers 2002*d* and 2002*e* and the pins 2002*f* of the first conveying drive roller 2002. FIG. 10D is a diagram illustrating the sheet P viewed from the direction C after the slack T of the sheet P is eliminated.

After formation of the slack T is completed as illustrated in FIGS. 6A and 6D, the timing roller pair 14 is rotated in synchronization with movement of the toner image formed on the intermediate transfer belt 601. At this time, the respective clutches for the relay roller pair 200 and the sheet feed roller 111*a* remain OFF, and therefore the relay roller pair 200 and the sheet feed roller 111*a* are not affected by the driving forces.

The sheet P is pulled toward a downstream side by driving the timing roller pair 14. Therefore, the idling roller 2002*d* is pulled by the sheet P to idly rotate in a direction indicated by arrow B in FIG. 10B on one side that has no slack of the sheet P, that is, on the side of the idling roller 2002*d* of the relay roller pair 200.

However, on the other side that has the slack T of the sheet P, that is, on the side of the idling roller 2002*e* of the relay roller pair 200, the slack T of the sheet P is gradually eliminated as the timing roller pair 14 is driven, so that the idling roller 2002*e* is not pulled by the sheet P in the direction B, which is toward the downstream side of rotation of the idling roller 2002*e*. Therefore, as illustrated in FIG. 10C, the idling roller 2002*e* remains unrotated until the slack T of the sheet P on the side of the idling roller 2002*e* is eliminated. This state of the idling roller 2002*e* illustrated in FIG. 10C is the same as the state of the idling roller 2002*e* illustrated in FIG. 6C.

With reference to FIG. 10D, the slack T in a left area LA of the sheet P is eliminated and a part of a right area RA of the sheet P is conveyed to the downstream side along with the idling of the idling roller 2002*d*. Accordingly, the elimination of the slack T on the left area LA of the sheet P occurs concurrently with the sheet conveyance of the right area RA of the sheet P. Therefore, the trailing edge of the sheet P slips to the right side of a shaft 111*b* or the conveying shaft 2001*c* in the axial direction, so as to gradually rotate without resistance in a direction indicted by arrow D in FIG. 10D. Thus, as the timing roller pair 14 is driven, the deviation of slacks T of the sheet P in the lateral direction is eliminated. It is to be noted that, in FIG. 10D, the second conveyance driven roller 142 and the idling rollers 2002*d* and 2002*e* are hidden behind the second conveyance drive roller 141 and the driven rollers 2001*a* and 2001*b*, respectively.

Figure 11A:
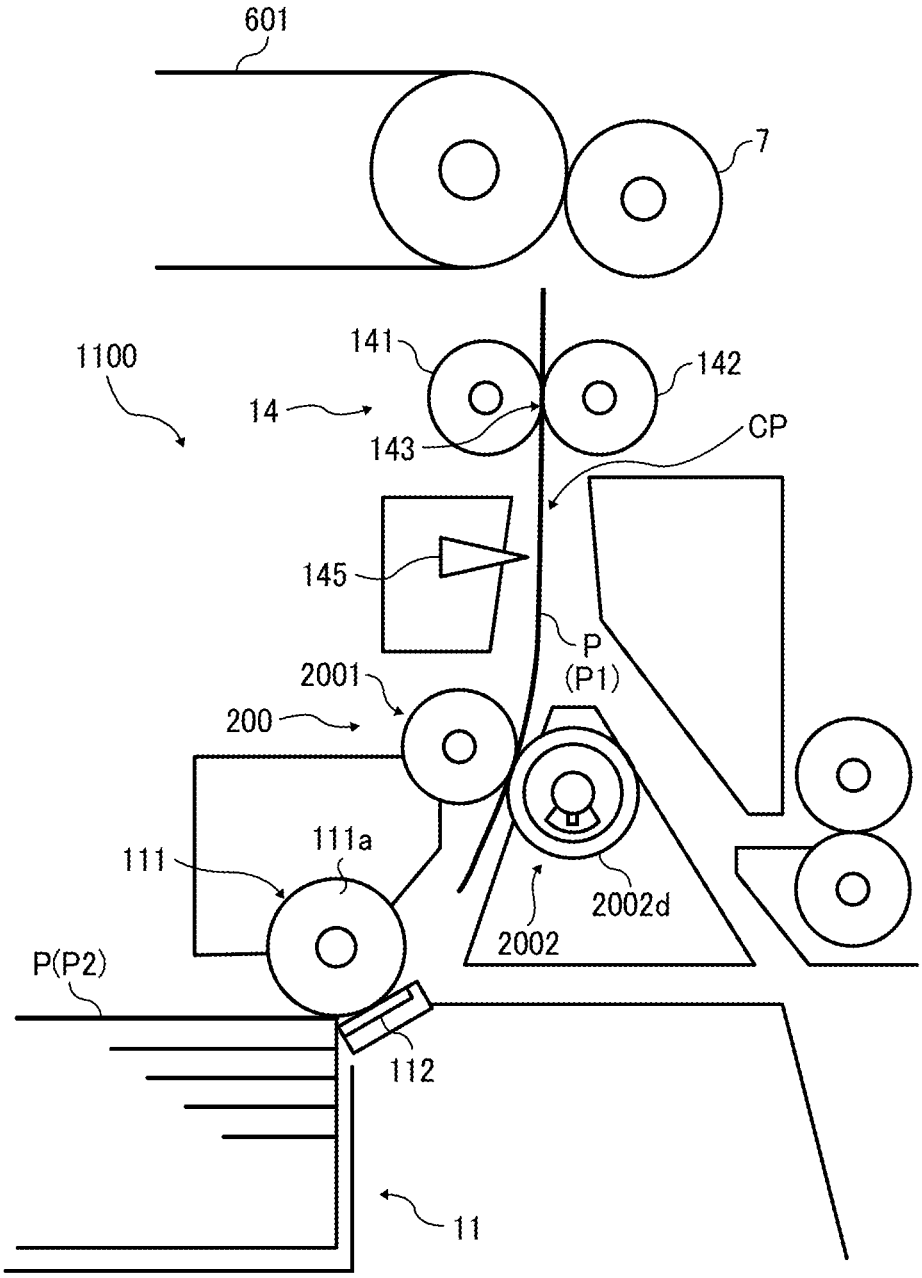
FIG. 11A is a diagram illustrating a schematic configuration of the sheet conveyor according to an embodiment when rollers of the sheet conveyor are stopped.
Figure 11B:
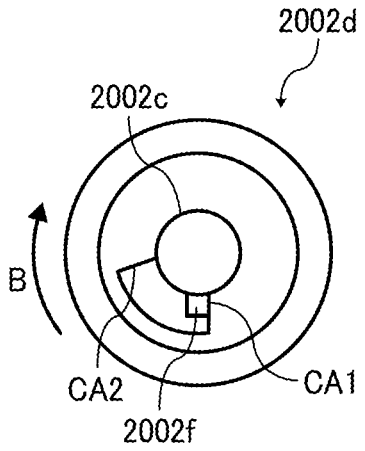
FIGS. 11B and 11C are side views illustrating the respective rollers and pins of the first conveying unit of FIG. 11A.
Figure 11C:
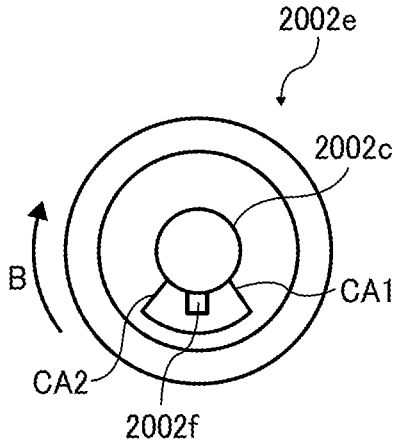

FIGS. 11A through 11C are diagrams illustrating the configurations of the sheet conveyor 1100 when the idling rollers 2002*d* and 2002*e* of the sheet conveyor 1100 remain stopped. FIG. 11A is a schematic configuration of the sheet conveyor 1100. FIGS. 11B and 11C are side views illustrating the idling rollers 2002*d* and 2002*e* and the pins 2002*f* of the first conveying drive roller 2002.

In FIGS. 11A through 11C, the deviation of slacks T of the sheet P has been eliminated, the idling roller 2002*d* has stopped idling, and the idling roller 2002*e* has started to rotate by being pulled according to conveyance of the sheet P. As the sheet conveying operation by the timing roller pair 14 proceeds, the idling roller 2002*d* having a smaller slack stops idling, so that the pin 2002*f* of the idling roller 2002*d* contacts a wall CA1, as illustrated in FIG. 11B. By contrast, since the idling roller 2002*e* having a greater slack has remained unrotated, for example, approximately the half of a room for idly rotating the idling roller 2002*d* is saved on an upstream side of the cutout CA.

The trailing edge of the sheet P that contacts the idling rollers 2002*d* and 2002*e* passes through the nip contact area formed between the friction pad 112 and the sheet feed roller 111*a* together with the driving or the timing roller pair 14, as illustrated in FIG. 11A. Thereafter, when the clutch turns on, the sheet feed roller 111*a* is rotated to start feeding a subsequent sheet.

Figure 12A:
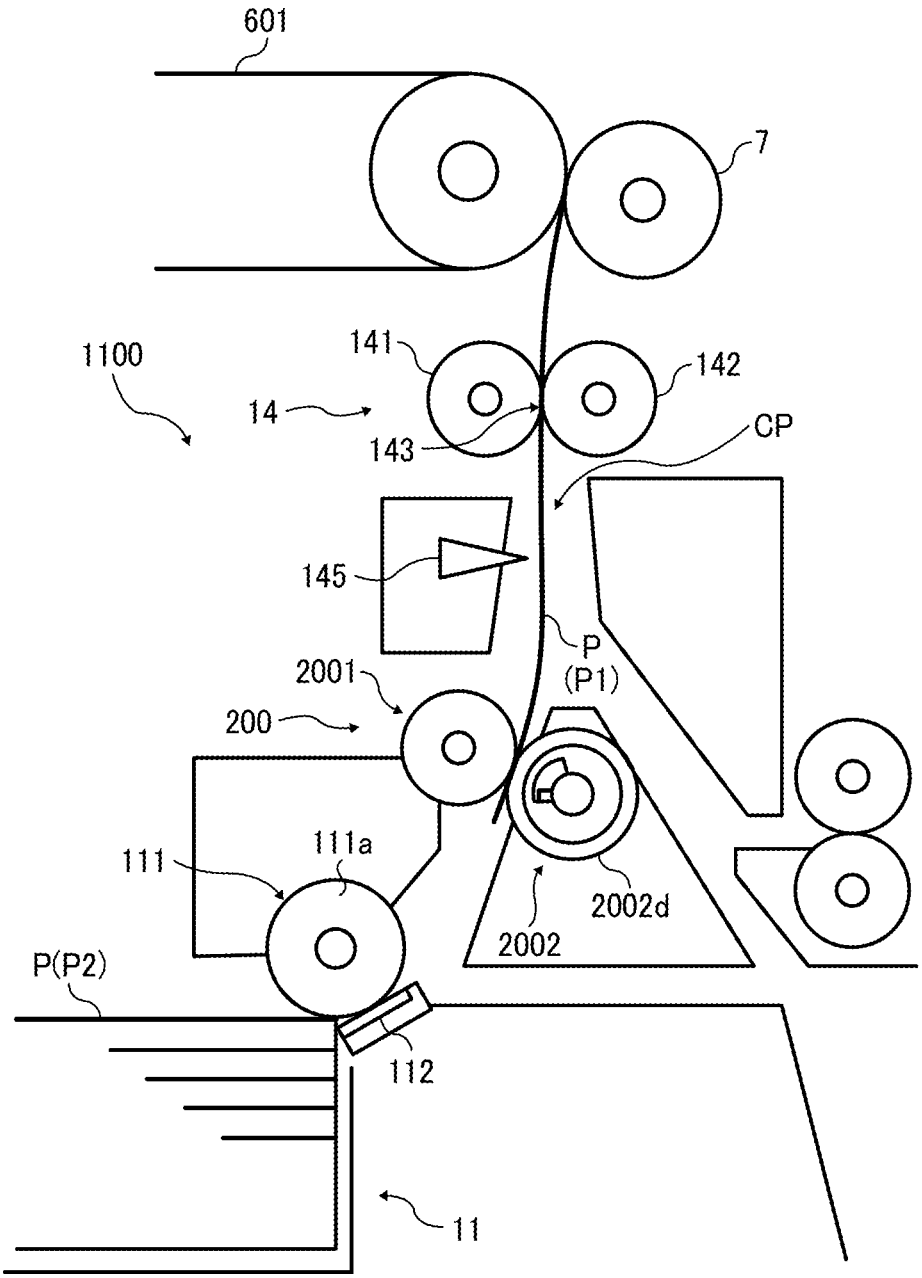
FIG. 12A is a diagram illustrating a schematic configuration of the sheet conveyor according to an embodiment when rollers of the sheet conveyor are rotated.
Figure 12B:
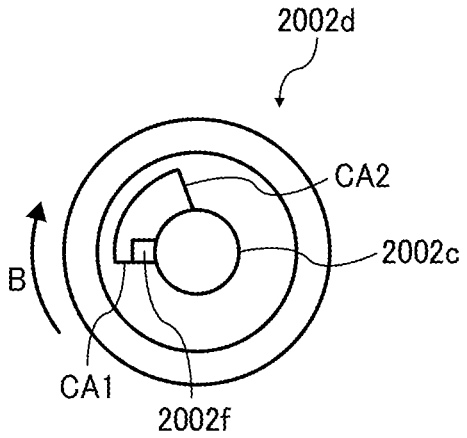
FIGS. 12B and 12C are side views illustrating the respective rollers and pins of the first conveying unit of FIG. 12A.
Figure 12C:
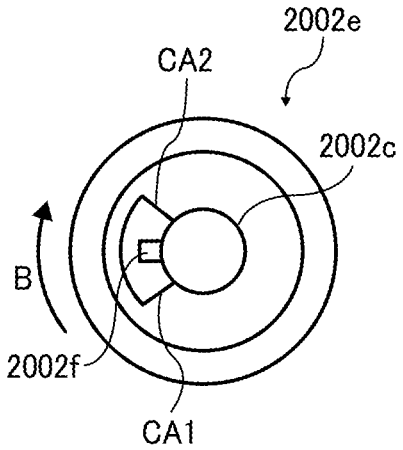

FIGS. 12A through 12C are diagrams illustrating the configurations of the sheet conveyor 1100, when the timing roller pair 14 rotates to cause the leading edge of the sheet P to reach the intermediate transfer belt 601. FIG. 12A is a schematic configuration of the sheet conveyor 1100. FIGS. 12B and 12C are side views illustrating the idling rollers 2002*d* and 2002*e* and the pins 2002*f* of the first conveying drive roller 2002.

As the sheet conveying operation by the timing roller pair 14 proceeds, the rotation of the idling roller 2002*d* having a smaller slack is transmitted to the conveying shaft 2002*c*, as illustrated in FIG. 12B. Therefore, the conveying shaft 2002*c* starts to rotate with the idling roller 2002*d*. By contrast, since the greater slack of the idling roller 2002*e* has already been eliminated as illustrated in FIG. 11A, the idling roller 2002*e* is rotated by being pulled by the sheet P as illustrated in FIG. 12C. However, via rotation of the idling roller 2002*d* and the pin 2002*f*, the conveying shaft 2002*c* is rotated at the same speed as the idling roller 2002*e*. Accordingly, the upstream and downstream spaces of the pin 2002*f* of the idling roller 2002*e* remain constant.

Figure 13A:
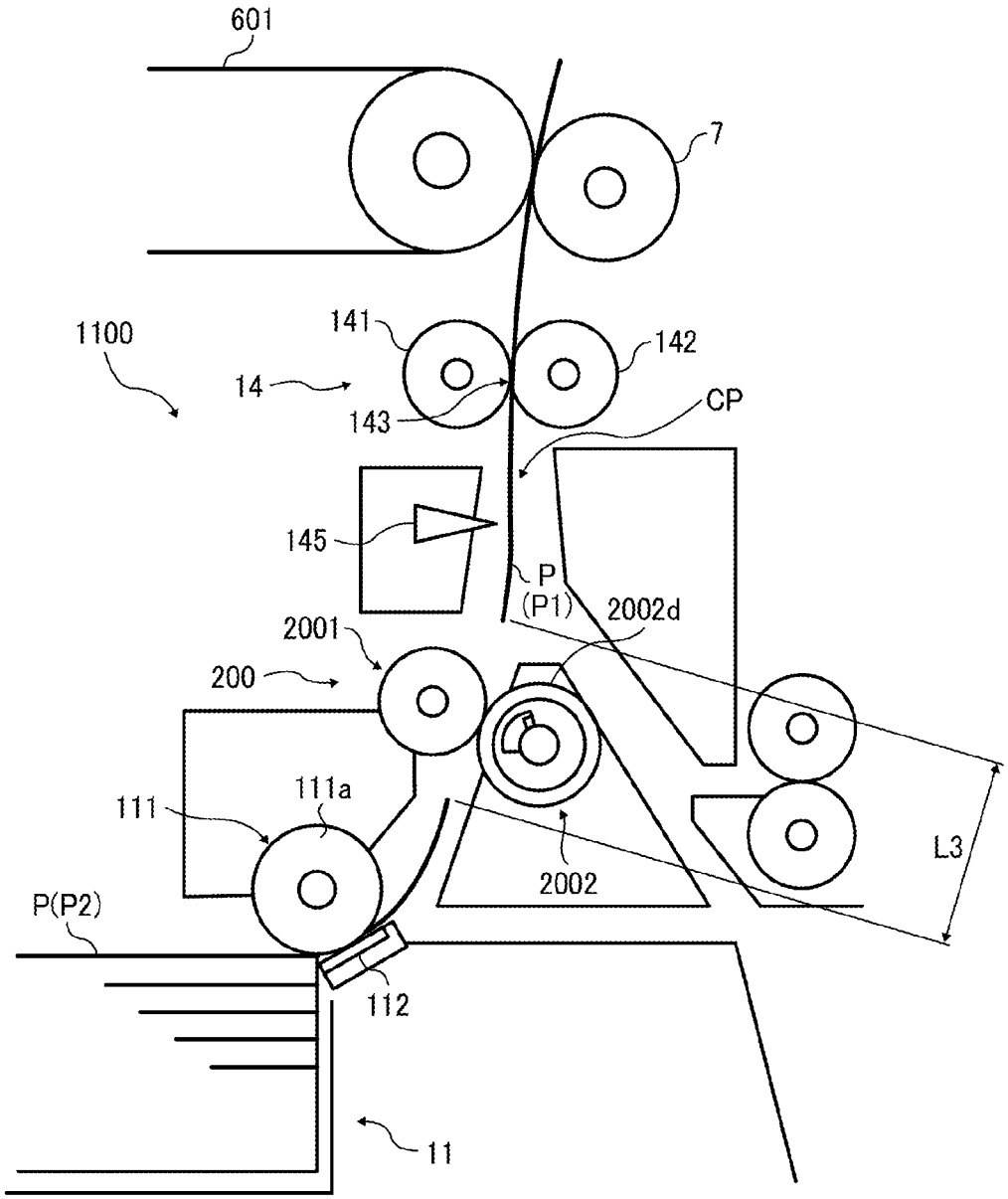
FIG. 13A is a diagram illustrating a schematic configuration of the sheet conveyor according to an embodiment when driving of the first conveying unit starts.
Figure 13B:
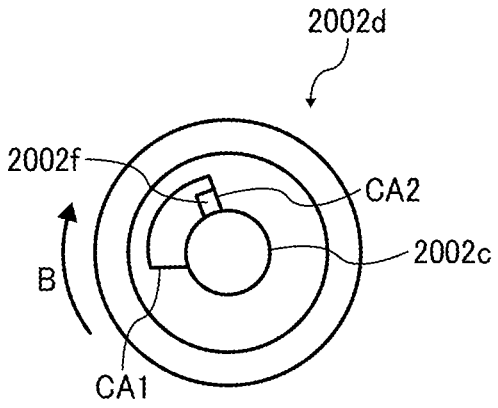
FIGS. 13B and 13C are side views illustrating the respective rollers and pins of the first conveying unit of FIG. 13A.
Figure 13C:
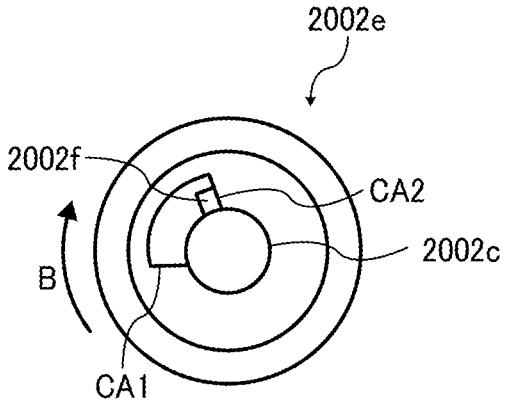

FIGS. 13A through 13C are diagrams illustrating the configurations of the sheet conveyor 1100 when the trailing edge of a preceding sheet P1 has passed through the relay roller pair 200 and the sheet feed roller 111*a* has started to feed a subsequent sheet P2. FIG. 13A is a schematic configuration of the sheet conveyor 1100. FIGS. 13B and 13C are side views illustrating the idling rollers 2002*d* and 2002*e* and the pins 2002*f* of the first conveying drive roller 2002.

As the sheet P is further conveyed after the states of FIGS. 12A through 12C, the leading edge of the preceding sheet P1 passes through the nip contact area formed between the first conveying drive roller 2002 and the first conveying driven roller 2001 of the relay roller pair 200, as illustrated in FIG. 13A. And, at the same time, rotation of the first conveying drive roller 2002 stops.

Thereafter, before the leading edge of the subsequent sheet P2 reaches the relay roller pair 200, the ON states of a driving source and a clutch apply a driving force to the first conveying drive roller 2002. Accordingly, as illustrated in FIGS. 13B and 13C, the idling rollers 2002*d* and 2002*e* idly rotate individually to fill the space formed between the pin 2002*f* and the wall CA2. Consequently, the phases of the idling rollers 2002*d* and 2002*e* in respective rotation directions are synchronized.

Then, as illustrated in FIGS. 6A through 6D, after passing the relay roller pair 200, the subsequent sheet P2 causes the leading edge thereof to abut against the sheet abutting part 143, which is a part of the timing roller pair 14, to form the slack T. Thereafter, the sheet conveying operation is performed in the above-described procedures.

As described above, the sheet conveyor 1100 according to the present embodiment has the configuration in which the relay roller pair 200 includes multiple idling rollers (e.g., the idling rollers 2002*d* and 2002*e* in the present embodiment) which are attached in an idly rotatable manner in a given constant range to the conveying shaft 2002*c*.

When the sheet P is set significantly obliquely in the sheet container 11 of the image forming apparatus 1000, this setting can cause the deviation of slacks on both left and right sides of the sheet P in the sheet conveying path CP between the relay roller pair 200 and the timing roller pair 14. Even if this inconvenience occurs, the idling rollers 2002*d* and 2002*e* of the relay roller pair 200 rotate according to the deviation of the slacks of the sheet P in the lateral direction. With this action, the sheet P rotates in a direction that eliminates the deviation of the slacks of the sheet P in the lateral direction.

Figure 14:
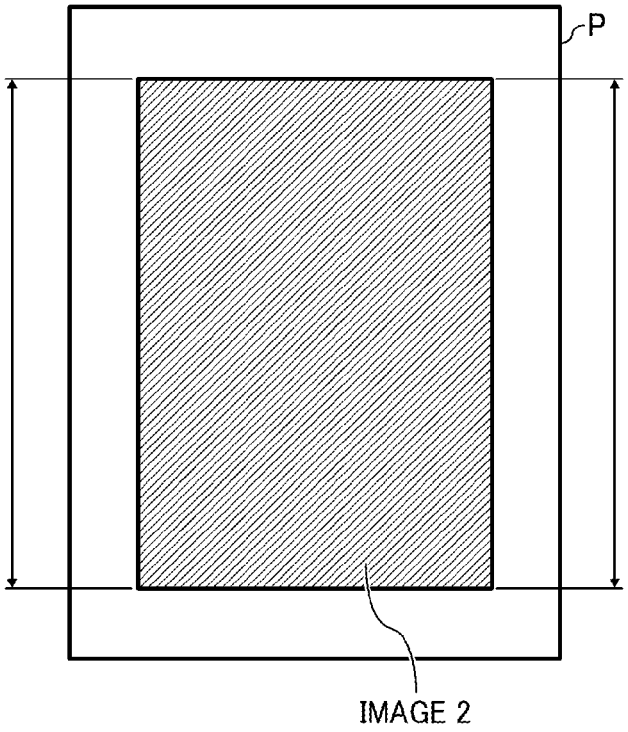
FIG. 14 is a diagram illustrating a normal image formed on the sheet.

Accordingly, while the toner image is being transferred onto the sheet P, the slippage of the sheet P in the lateral direction becomes uniform at the transfer unit 7. As a result, a good image (IMAGE 2) having equal image lengths on both left and right sides of the sheet P as illustrated in FIG. 14 can be obtained, and production of the trapezoidal image can be prevented. Further, the idling rollers 2002*d* and 2002*e* of the relay roller pair 200 are fixed to the conveying shaft 2002*c* in the axial direction. Therefore, the idling rollers 2002*d* and 2002*e* can do without positioning in the axial direction in the intervals of sheets (for example, the interval of the preceding sheet P1 and the subsequent sheet P2) and this action can achieve high productivity of prints.

Further, by regulating an idling range to a given constant range, as illustrated in FIGS. 7, 8, 9A, and 9B, the sheet conveyor 1100 has an idling configuration with the rotation regulator. Therefore, accurate skew correction, prevention of image defects (for example, a trapezoidal image), and high printing performance can be achieved with a low-cost configuration including no electric components and springs.

Further, the maximum idling distance of the idling rollers 2002*d* and 2002*e* of the relay roller pair 200 is greater than a slack elimination distance that is formed on one of the left and right sides of the sheet P. By so doing, when the timing roller pair 14 conveys the sheet P, the deviation of the slacks of the sheet P in the lateral direction can be completely eliminated reliably. Therefore, prevention of the trapezoidal image can be achieved reliably.

Specifically, a relation of the maximum idling distance L1 and the slack elimination distance L2 is expressed by a formula:

$$L1(=Di\theta/2)>L2,$$

where "L1" represents the maximum idling distance of the idling rollers 2002*d* and 2002*e* of the relay roller pair 200 and "L2" represents the slack elimination distance.

Figure 15:
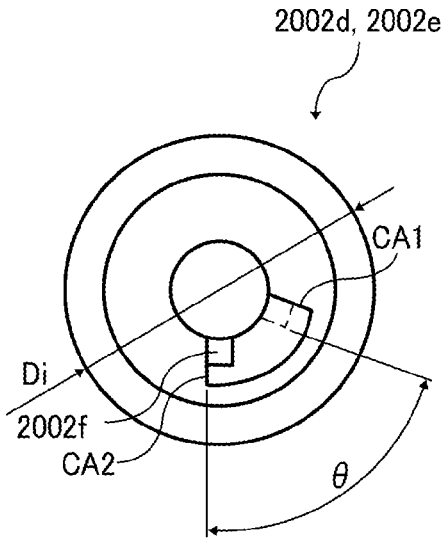
FIG. 15 is a side view illustrating the roller of the first conveying unit.

Further, as illustrated in FIG. 15, "θ" or "θ(rad)" represents an idling angle and "Di" represents a diameter of the first conveying drive roller 2002.

With the equation of this relation, occurrence of the trapezoidal image can be prevented reliably.

In the present embodiment, as illustrated in FIG. 13A, the relay roller pair 200 remains unrotated until the trailing edge of the sheet P (the sheet P1) passes through the nip contact area formed between the first conveying drive roller 2002 and the first conveying driven roller 2001 of the relay roller pair 200.

For example, the relay roller pair 200 may rotate with the sheet P held at the nip contact area of the relay roller pair 200 before the trailing edge of the sheet P (the sheet P1) passes through the nip contact area formed between the first conveying drive roller 2002 and the first conveying driven roller 2001 of the relay roller pair 200.

In this case, since the idling rollers 2002*d* and 2002*e* have different initial phases on both left and right sides of the sheet P when the driving starts (refer to FIGS. 12B and 12C), a timing at which the driving force is transmitted to the idling roller 2002*d* is different from a timing at which the driving force is transmitted to the idling roller 2002*e* at the driving of the idling rollers 2002*d* and 2002*e*. Therefore, uneven conveying forces may be applied to the sheet P to produce wrinkles on the sheet P.

To prevent this inconvenience, the relay roller pair 200 preferably starts to drive after the trailing edge of the sheet P has passed through the relay roller pair 200 as described above.

Further, it is preferable that a sheet interval L3 (a distance between two consecutive sheets, e.g., a distance between the trailing edge of the preceding sheet P1 and the leading edge of the subsequent sheet P2) illustrated in FIG. 13A is greater than the maximum idling length L1. It is because, when the sheet interval L3 corresponds to the relay roller pair 200 (i.e., when none of the preceding sheet P1 and the subsequent sheet P2 is out of the range of the relay roller pair 200), the phase difference between the idling rollers 2002*d* and 2002*e* on the left and right sides of the sheet P can be cleared to zero, which is an initial value, by driving the relay roller pair 200. Therefore, even any sheets after the second or subsequent sheet P2 is conveyed, the phase difference between the idling rollers 2002*d* and 2002*e* can be cleared to the initial zero value per sheet, and therefore occurrence of the trapezoidal image can be prevented constantly.

Figure 16:
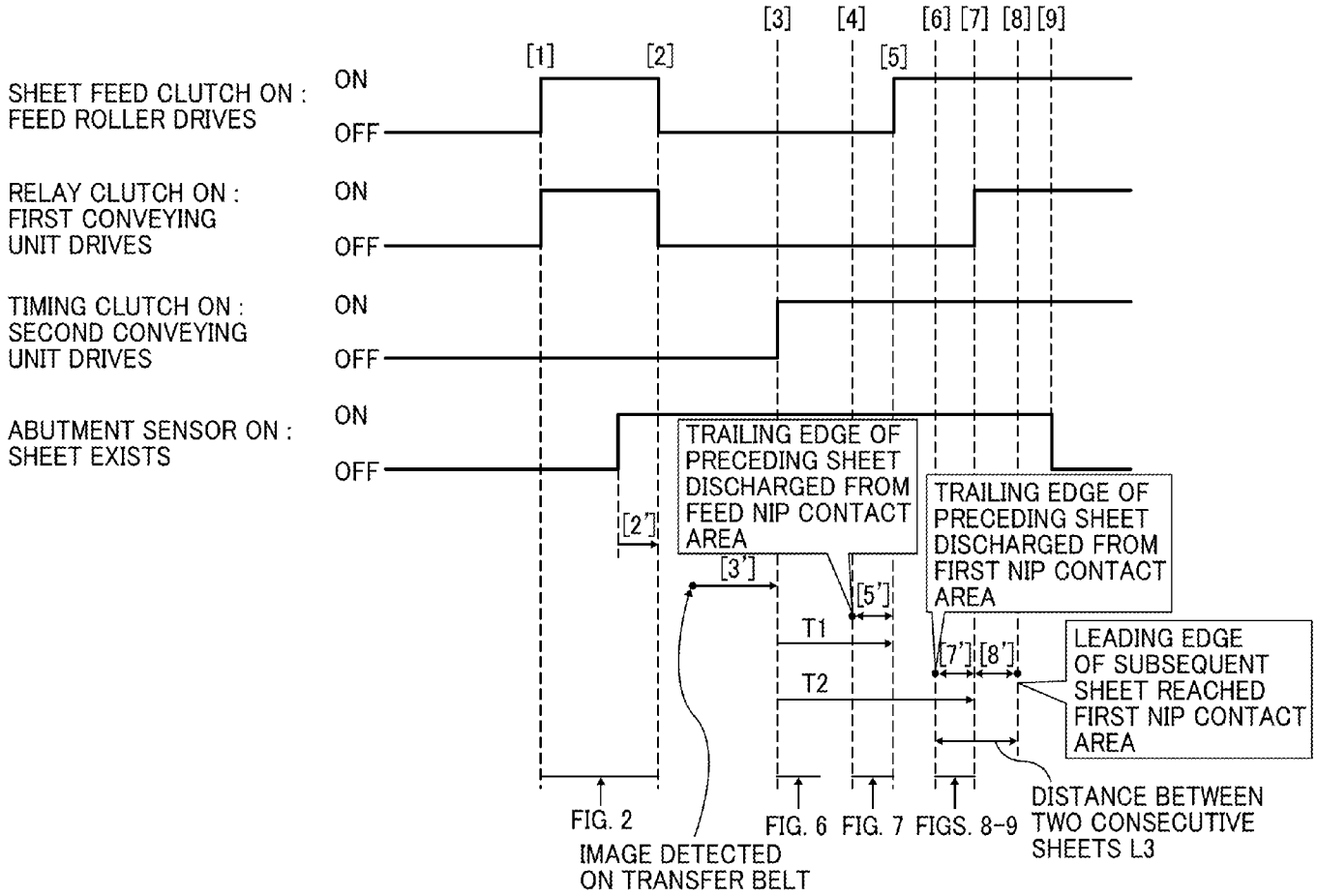
FIG. 16 is a diagram illustrating a timing chart of the sheet conveyor of FIG. 5.

FIG. 16 is a diagram illustrating a timing chart of the sheet conveyor 1100 of FIG. 5. The timing chart relates to each clutch control of the above-described sheet conveying operation. In the timing chart of FIG. 16, the nip contact area of the sheet feed roller 111*a* is referred to as a "feed nip contact area" and the nip contact area of the relay roller pair 200 is referred to as a "first nip contact area".

A sheet feed clutch controls driving of the sheet feed roller 111*a* by switching ON/OFF. A relay clutch controls driving of the relay roller pair 200, more specifically, of the first conveying drive roller 2002 by switching ON/OFF. A timing clutch controls driving of the second conveying unit 14, more specifically, of the second conveyance drive roller 141 by switching ON/OFF.

A timing [1] in the timing chart of FIG. 16 indicates a sheet feed start timing of a first sheet (a proceeding sheet). At this time, both the sheet feed clutch and the relay clutch are ON.

A timing [2] in the timing chart of FIG. 16 indicates a slack formation completion timing. After a time duration [2'] has elapsed since the switch ON of the abutment sensor 145, both the sheet feed clutch and the relay clutch are switched to OFF. Sheet movements during a period between the timing [1] and the timing [2] are illustrated in FIGS. 6A through 6D.

Further, respective idle distances of the idling rollers 2002*d* and 2002*e* of the first conveying drive roller 2002 are greater than a slack elimination distance that is calculated based on the time duration [2']. A timing [3] is a sheet feed restart timing by the timing roller pair 14. After a time duration [3'] has elapsed since detection of the image formed on the intermediate transfer belt 601, the timing clutch becomes ON. Sheet movements during a period between the timing [2] and the timing [3] correspond to FIGS. 10A through 10D.

A timing [4] in the timing chart of FIG. 16 indicates a timing in which the trailing edge of the first sheet (the proceeding sheet) passes through the nip contact area of the sheet feed roller 111*a* (the feed nip contact area).

A timing [5] in the timing chart of FIG. 16 indicates a sheet feed start timing of a second sheet (a subsequent sheet). After a time duration [5'] has elapsed since the timing clutch ON of the timing [3], the sheet feed clutch is switched ON. A time T1 that extends from the timing clutch ON to the sheet feed clutch ON is a value obtained by calculation based on the time duration [5'] and the lengths of the conveyance path and the sheet. Sheet movements during a period between the timing [4] and the timing [5] are illustrated in FIGS. 11A through 11C.

A timing [6] in the timing chart of FIG. 16 indicates a timing in which the trailing edge of the first sheet (the preceding sheet) passes through the nip contact area of the relay roller pair 200 (the first nip contact area).

A timing [7] in the timing chart of FIG. 16 indicates a drive start timing of the relay roller pair 200 for sheet conveyance of the second sheet (the subsequent sheet). After a time duration [7'] has elapsed since the timing clutch ON of the timing [3], the relay clutch is switched ON. A time T2 that extends from the timing clutch ON to the relay clutch ON is a value obtained by calculation based on the time duration [7'] and the lengths of the conveyance path and the sheet.

Sheet movements during a period between the timing [6] and the timing [7] correspond to FIGS. 12A through 13C.

A timing [8] in the timing chart of FIG. 16 indicates a timing in which the leading edge of the second sheet (the subsequent sheet) reaches the first nip contact area.

A timing [9] in the timing chart of FIG. 16 indicates a timing in which the trailing edge of the first sheet (the preceding sheet) passes through the abutment sensor 145.

After a time duration [8'] has elapsed since the drive start of the relay roller pair 200 of the timing [7] for sheet conveyance of the second sheet (the subsequent sheet), the leading edge of the subsequent sheet reaches the first nip contact area. During the time duration [8'], the respective pins 2002*f* of the idling rollers 2002*d* and 2002*e* are aligned in the initial phase positions, as illustrated in FIGS. 13B and 13C. In other words, after the conveying shaft 2002*c* of the relay roller pair 200 rotates for a time period greater than the maximum idle distances of the idling rollers 2002*d* and 2002*e* of the first conveying drive roller 2002, the leading edge of the subsequent sheet reaches the nip contact area of the relay roller pair 200 (the first nip contact area) to be fed by the idling rollers 2002*d* and 2002*e*.

Figure 17:
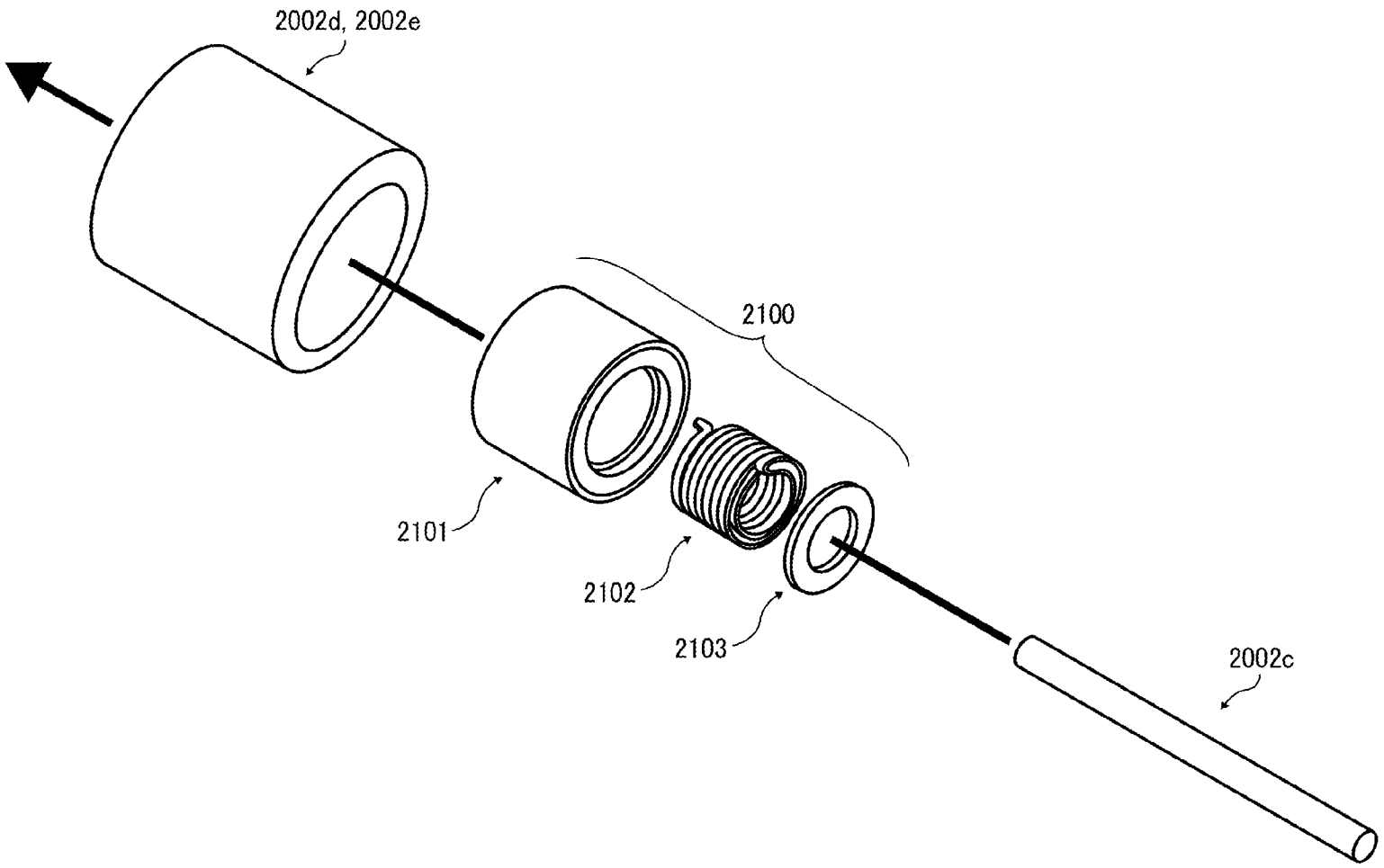
FIG. 17 is a diagram of a one-way clutch that can be included in the sheet conveyor of FIG. 5.

Embodiments of the present invention are not limited to the above-described configurations. Specifically, the idling rollers 2002*d* and 2002*e* are not limited to have the configuration in which the idling rollers 2002*d* and 2002*e* rotate in a given region as illustrated in FIGS. 7 through 9B. For example, as illustrated in FIG. 17, a one-way clutch 2100 can be disposed between the conveying shaft 2002*c* and the respective idling rollers 2002*d* and 2002*e*. By so doing, the idling rollers 2002*d* and 2002*e* can idle in a given single direction, which is the sheet conveying direction, without the idling range of the idling rollers 2002*d* and 2002*e*.

The one-way clutch 2100 includes an outer ring 2101, a clutch spring 2102, and a cap 2103. By pressing each of the idling rollers 2002*d* and 2002*e* to fit to the one-way clutch 2100 in a direction indicated by arrow in FIG. 17, the idling rollers 2002*d* and 2002*e* are attached to the conveying shaft 2002*c*. In this case, there is no phase difference between the idling rollers 2002*d* and 2002*e*, and therefore the maximum idling length L1 is not considered with respect to the drive start of the relay roller pair 200. Accordingly, the sheet intervals (for example, the sheet intervals L3 can be reduced). Consequently, image defects to form a trapezoidal image can be prevented and high productivity can be achieved.

Further, in this case, after the preceding sheet P1 is conveyed by the timing roller pair 14 by the slack elimination distance, the relay roller pair 200 starts, By so doing, when the sheet P is conveyed by the timing roller pair 14, the deviation of slacks on both left and right sides of the sheet P completely, and therefore production of the trapezoidal image can be prevented reliably.

In the embodiment(s) described above, the timing roller pair 14 is a pair of rollers that can be driven, and the nip contact area of the timing roller pair 14 functions as the sheet abutting part 143 when the timing roller pair 14 remains stopped. By so doing, the timing roller pair 14 functions as the sheet abutting part 143. Accordingly, a reduction in cost can be achieved.

It is to be noted that the sheet abutting part 143 can be a separate part disposed upstream from the nip contact area of the timing roller pair 14.

Further, the sheet conveyor can be incorporated in an image forming apparatus such as a printer and a copier as illustrated in FIG. 5.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet conveyor comprising:

a sheet conveying path through which a sheet is conveyed;

a first conveying unit disposed along the sheet conveying path in a sheet conveying direction, the first conveying unit comprising:

a shaft extending in a lateral direction perpendicular to the sheet conveying direction;

multiple rollers on the shaft in the lateral direction along the shaft; and a rotation regulator formed as a cutout portion in a first face of a hub of each of the multiple rollers and a pin attached to the shaft, wherein the pin engages the cutout portion to cause each of the multiple rollers to idly rotate in a limited range about the shaft;

a second conveying unit disposed along the sheet conveying path and downstream from the first conveying unit in the sheet conveying direction; and a sheet abutting part provided at the second conveying unit, against which a leading edge of the sheet conveyed from the first conveying unit abuts to form a slack of the sheet to correct skew of the sheet, wherein each of the multiple rollers has a maximum idling length of greater than a slack elimination distance formed at the sheet abutting part.

2. The sheet conveyor according to claim 1, wherein the second conveying unit rotates after the leading edge of the sheet abuts against the sheet abutting part, wherein the shaft of the first conveying unit rotates after the second conveying unit conveys the sheet for a given distance.

3. The sheet conveyor according to claim 1, wherein the shaft of the first conveying unit rotates to feed a subsequent sheet after a trailing edge of a preceding sheet passes through the first conveying unit due to rotation of the second conveying unit.

4. The sheet conveyor according to claim 3, wherein, after the shaft moves by a distance greater than a maximum idling length of each of the multiple rollers, a leading edge of the subsequent sheet reaches the first conveying unit and each of the multiple rollers conveys the subsequent sheet.

5. The sheet conveyor according to claim 1, wherein the rotation regulator further includes a retaining ring attached to the shaft and facing a second face of the hub.

6. The sheet conveyor according to claim 1, wherein the first conveying unit rotates to feed a subsequent sheet after the second conveying unit conveys a preceding sheet by a slack elimination distance formed at the sheet abutting part.

7. The sheet conveyor according to claim 1, wherein the second conveying unit is a roller pair to rotate with the sheet conveying path interposed therebetween, wherein the sheet abutting part corresponds to a nip contact area formed between the roller pair when the roller pair stops.

8. An image forming apparatus comprising:

an image forming part to form an image; and the sheet conveyor according to claim 1.

9. A method of preventing sheet skew, comprising:

providing a first conveying unit and a second conveying unit in a sheet conveying path of an image forming apparatus, the first conveying unit having a shaft and multiple rollers on the shaft in an axial direction;

disposing a rotation regulator within a hub of each of the multiple rollers and disposing a pin in the shaft the shaft;

conveying a sheet between the first conveying unit and the second conveying unit through the sheet conveying path;

causing a leading edge of the sheet to abut against a sheet abutting part of the second conveying unit;

forming given amounts of slack on both opposite sides of the sheet; and regulating idle rotation of the multiple rollers in a limited range by the rotation regulator and according to deviation of the amount of slack in the sheet, wherein each of the multiple rollers has a maximum idling length greater than a slack elimination distance formed at the sheet abutting part.

10. The method of preventing sheet skew according to claim 9, wherein the second conveying unit rotates after the leading edge of the sheet abuts against the sheet abutting part, wherein the shaft of the first conveying unit rotates after the second conveying unit conveys the sheet for a given distance.

11. The method of preventing sheet skew according to claim 9, wherein the shaft of the first conveying unit rotates to feed a subsequent sheet after a trailing edge of a preceding sheet passes through the first conveying unit due to rotation of the second conveying unit.

12. The method of preventing sheet skew according to claim 11, wherein, after the shaft moves by a distance greater than a maximum idling length of each of the multiple rollers, a leading edge of the subsequent sheet reaches the first conveying unit and each of the multiple rollers conveys the subsequent sheet.

13. The method of preventing sheet skew according to claim 9, further comprising:

providing a cutout in a face of a hub of each of the multiple rollers; and regulating the idle rotation of the multiple rollers with the pin contacting the cutout.

* * * * *